US010071292B2

(12) United States Patent
Wu et al.

(10) Patent No.: US 10,071,292 B2
(45) **Date of Patent: *Sep. 11, 2018**

(54) CO-FORGED GOLF CLUB HEAD AND METHOD OF MANUFACTURE

(71) Applicant: Acushnet Company, Fairhaven, MA (US)

(72) Inventors: Michael Wu, Guangdong (CN); Jonathan Hebreo, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/455,781

(22) Filed: Mar. 10, 2017

(65) Prior Publication Data

US 2017/0182385 A1 Jun. 29, 2017

Related U.S. Application Data

(63) Continuation of application No. 14/580,894, filed on Dec. 23, 2014, now Pat. No. 9,616,303, which is a (Continued)

(51) Int. Cl.
*A63B 53/04* (2015.01)
*A63B 53/06* (2015.01)

(52) U.S. Cl.
CPC ..... *A63B 53/06* (2013.01); *A63B 53/047* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS 819,900 A 5/1906 Martin
1,453,503 A * 5/1923 Holmes ..... A63B 53/08 473/336

(Continued)

FOREIGN PATENT DOCUMENTS

EP 1892019 A1 2/2008
JP 07-222830 8/1995

(Continued)

OTHER PUBLICATIONS

U.S. Appl. No. 15/379,784, filed Dec. 15, 2016, Jonathan Hebreo.

(Continued)

*Primary Examiner* — Alvin Hunter
(74) *Attorney, Agent, or Firm* — Randy K. Chang

(57) ABSTRACT

A co-forged iron type golf club is disclosed. More specifically, the present invention discloses a co-forged iron type golf club with the body portion made out of a first material and at least one weight adjustment portion monolithically encased within the body portion of the co-forged iron type golf club head without the need for secondary attachment or machining operations. The present invention creates of an iron type golf club head from a pre-form billet that already contains two or more materials before the actual forging process resulting in a multi-material golf club head that doesn't require any post manufacturing operations such as machining, welding, swaging, gluing, and the like.

10 Claims, 21 Drawing Sheets

Related U.S. Application Data continuation-in-part of application No. 14/078,380, filed on Nov. 12, 2013, now Pat. No. 9,387,370, which is a continuation-in-part of application No. 13/927,764, filed on Jun. 26, 2013, now abandoned, which is a continuation-in-part of application No. 13/305,087, filed on Nov. 28, 2011, now Pat. No. 8,926,451.

(56) References Cited

U.S. PATENT DOCUMENTS 1,968,626 A 7/1934 Young
2,998,254 A * 8/1961 Rains ..... A63B 53/0487 473/336
3,084,940 A 4/1963 Cissel
3,695,618 A 10/1972 Wolley et al.
3,825,991 A * 7/1974 Cornell ..... A63B 53/04 228/164
3,845,960 A * 11/1974 Thompson ..... A63B 53/04 473/336
3,847,399 A 11/1974 Raymont
3,955,820 A 5/1976 Cochran et al.
3,970,236 A 7/1976 Rogers
3,979,122 A * 9/1976 Belmont ..... A63B 53/047 473/336
3,995,865 A * 12/1976 Cochran ..... A63B 53/04 473/337
4,206,924 A * 6/1980 Koralik ..... A63B 53/04 473/349
4,398,965 A 8/1983 Campau
4,523,759 A 6/1985 Igarashi
4,607,846 A * 8/1986 Perkins ..... A63B 53/047 473/312
4,650,191 A * 3/1987 Mills ..... A63B 69/3632 473/341
4,664,383 A 5/1987 Aizawa
4,780,948 A 11/1988 Ferguson et al.
4,792,139 A 12/1988 Nagasaki
4,793,616 A 12/1988 Fernandez
4,798,383 A 1/1989 Nagasaki
4,809,977 A 3/1989 Doran et al.
4,824,115 A * 4/1989 Walther ..... A63B 53/0487 473/341
4,852,880 A * 8/1989 Kobayashi ..... A63B 53/04 473/349
4,884,812 A 12/1989 Nagasaki
4,928,972 A 5/1990 Nakanishi et al.
5,013,041 A * 5/1991 Sun ..... A63B 53/04 473/252
5,050,879 A 9/1991 Sun et al.
5,074,563 A 12/1991 Gorman
5,176,384 A 1/1993 Sata et al.
5,221,087 A * 6/1993 Fenton ..... A63B 53/04 473/342
5,282,624 A * 2/1994 Viste ..... A63B 53/04 473/342
5,301,941 A 4/1994 Allen
5,328,175 A * 7/1994 Yamada ..... A63B 53/04 473/345
5,348,302 A * 9/1994 Sasamoto ..... A63B 53/04 273/DIG. 23
5,377,986 A 1/1995 Viollaz et al.
5,407,202 A * 4/1995 Igarashi ..... A63B 53/04 473/342
5,485,998 A 1/1996 Kobayashi
5,486,000 A 1/1996 Chorne
5,529,543 A 6/1996 Beaumont, Sr.
5,584,770 A * 12/1996 Jensen ..... A63B 53/04 473/334
5,616,088 A 4/1997 Aizawa et al.
5,669,827 A 9/1997 Nagamoto
5,683,307 A 11/1997 Rife
5,720,673 A * 2/1998 Anderson ..... A63B 53/04 473/324
5,735,755 A * 4/1998 Kobayashi ..... A63B 53/04 473/331
5,766,091 A 6/1998 Humphrey et al.
5,766,092 A 6/1998 Mimeur et al.
5,766,094 A 6/1998 Mahaffey
5,827,131 A 10/1998 Mahaffey
5,876,293 A * 3/1999 Musty ..... A63B 53/0487 473/341
5,885,170 A 3/1999 Takeda
5,961,394 A 10/1999 Minabe
5,964,669 A * 10/1999 Bloomer ..... A63B 53/0487 273/DIG. 14
5,967,903 A 10/1999 Cheng
5,993,331 A 11/1999 Shieh
6,015,354 A * 1/2000 Ahn ..... A63B 53/04 473/256
6,045,456 A 4/2000 Best et al.
6,074,309 A 6/2000 Mahaffey
6,077,171 A 6/2000 Yoneyama
6,083,118 A * 7/2000 Martins ..... A63B 53/04 473/334
6,095,931 A 8/2000 Hettinger et al.
6,099,414 A 8/2000 Kusano et al.
6,183,381 B1 2/2001 Grant et al.
6,200,228 B1 * 3/2001 Takeda ..... A63B 53/04 473/324
6,257,603 B1 7/2001 Busch et al.
6,299,548 B1 * 10/2001 Lin ..... A63B 53/04 473/331
6,299,648 B1 10/2001 Lin
6,302,804 B1 * 10/2001 Budde ..... A63B 53/0487 273/DIG. 8
6,434,811 B1 8/2002 Helmstetter et al.
6,450,894 B1 * 9/2002 Sun ..... A63B 53/0487 473/252
6,454,665 B2 9/2002 Antonious
6,497,629 B2 12/2002 Takeda
6,508,722 B1 * 1/2003 McCabe ..... A63B 53/04 473/330
6,551,200 B1 4/2003 Golden et al.
6,616,547 B2 9/2003 Vincent et al.
6,666,779 B1 12/2003 Iwata et al.
6,729,209 B1 5/2004 Chen
6,743,117 B2 6/2004 Gilbert
6,777,640 B2 8/2004 Takeda
6,881,158 B2 4/2005 Yang et al.
6,921,343 B2 * 7/2005 Solheim ..... A63B 53/04 473/329
6,923,734 B2 * 8/2005 Meyer ..... A63B 53/047 473/336
6,932,875 B2 8/2005 Cheng et al.
7,018,303 B2 * 3/2006 Yamamoto ..... A63B 53/04 473/329
7,040,000 B2 * 5/2006 Takeda ..... A63B 53/04 29/505
7,169,062 B2 * 1/2007 Chen ..... A63B 53/0466 473/329
7,207,899 B2 4/2007 Imamoto
7,232,380 B2 6/2007 Nakahara
7,303,485 B2 * 12/2007 Tseng ..... A63B 53/04 473/332
7,309,297 B1 12/2007 Solari
7,326,472 B2 2/2008 Shimazaki et al.
7,338,388 B2 * 3/2008 Schweigert ..... A63B 53/0466 473/342
7,361,099 B2 4/2008 Rice et al.
7,380,325 B2 * 6/2008 Takeda ..... A63B 53/04 29/505
7,448,961 B2 * 11/2008 Lin ..... A63B 53/04 473/332
7,559,854 B2 * 7/2009 Harvell ..... A63B 53/0466 473/334
7,585,232 B2 9/2009 Krumme
7,744,484 B1 6/2010 Chao

(56) References Cited

U.S. PATENT DOCUMENTS

| | | | | |
|---|---|---|---|---|
| 7,794,335 | B2 * | 9/2010 | Cole | A63B 53/04 473/342 |
| 7,815,523 | B2 | 10/2010 | Knutson et al. | |
| 7,828,674 | B2 | 11/2010 | Kubota | |
| 7,867,105 | B2 | 1/2011 | Moon | |
| 7,914,394 | B2 * | 3/2011 | Cole | A63B 53/047 473/332 |
| 7,938,739 | B2 | 5/2011 | Cole et al. | |
| 7,976,403 | B2 | 7/2011 | Gilbert et al. | |
| 8,042,253 | B2 | 10/2011 | Su | |
| 8,088,023 | B2 | 1/2012 | Kubota | |
| 8,206,237 | B2 | 6/2012 | Gilbert et al. | |
| 8,235,843 | B1 | 8/2012 | Rice et al. | |
| 8,337,325 | B2 | 12/2012 | Boyd et al. | |
| 8,376,878 | B2 * | 2/2013 | Bennett | A63B 53/0475 473/334 |
| 8,409,032 | B2 | 4/2013 | Myrhum et al. | |
| 8,434,671 | B1 * | 5/2013 | Su | A63B 53/04 228/227 |
| 8,449,405 | B2 | 5/2013 | Jertson et al. | |
| 8,535,177 | B1 * | 9/2013 | Wahl | A63B 60/54 473/290 |
| 8,540,589 | B2 * | 9/2013 | Bezilla | A63B 53/04 473/335 |
| 8,632,419 | B2 * | 1/2014 | Tang | A63B 53/04 473/329 |
| 8,663,027 | B2 | 3/2014 | Morales et al. | |
| 8,894,508 | B2 | 11/2014 | Myrhum et al. | |
| 8,926,451 | B2 * | 1/2015 | Deshmukh | B21K 17/00 473/349 |
| 8,936,518 | B2 * | 1/2015 | Takechi | A63B 53/047 473/335 |
| 9,387,370 | B2 * | 7/2016 | Hebreo | B21K 17/00 |
| 9,504,887 | B2 * | 11/2016 | Ines | A63B 53/047 |
| 9,616,303 | B2 * | 4/2017 | Wu | A63B 53/047 |
| 9,616,304 | B2 * | 4/2017 | Deshmukh | A63B 53/047 |
| 2002/0019265 | A1 | 2/2002 | Allen | |
| 2002/0019266 | A1 | 2/2002 | Yabu | |
| 2002/0061788 | A1 * | 5/2002 | Marcase | A63B 53/04 473/324 |
| 2003/0015015 | A1 | 1/2003 | Takeda | |
| 2003/0181257 | A1 * | 9/2003 | Yamamoto | A63B 53/04 473/342 |
| 2004/0043830 | A1 | 3/2004 | Imamoto | |
| 2004/0231132 | A1 | 11/2004 | Takeda | |
| 2005/0020378 | A1 | 1/2005 | Krumme et al. | |
| 2005/0197208 | A1 | 9/2005 | Imamoto | |
| 2007/0281796 | A1 | 12/2007 | Gilbert et al. | |
| 2008/0076595 | A1 | 3/2008 | Lai et al. | |
| 2008/0085782 | A1 | 4/2008 | Kubota | |
| 2008/0194374 | A1 | 8/2008 | Diosi et al. | |
| 2008/0318708 | A1 | 12/2008 | Clausen | |
| 2009/0298615 | A1 | 12/2009 | Moon | |
| 2011/0021290 | A1 | 1/2011 | Kubota | |
| 2012/0186060 | A1 | 7/2012 | Su | |
| 2013/0119599 | A1 | 5/2013 | Byrne | |
| 2013/0137532 | A1 | 5/2013 | Deshmukh et al. | |
| 2013/0281229 | A1 | 10/2013 | Su | |
| 2013/0288823 | A1 | 10/2013 | Hebreo | |
| 2013/0305801 | A1 | 11/2013 | Liang et al. | |
| 2014/0073450 | A1 | 3/2014 | Hebreo et al. | |
| 2014/0123471 | A1 | 5/2014 | Su | |
| 2014/0148271 | A1 | 5/2014 | Myrhum et al. | |

FOREIGN PATENT DOCUMENTS

| | | | | | |
|---|---|---|---|---|---|
| JP | 08-308964 | | | 11/1996 | |
| JP | 08-308965 | A | | 11/1996 | |
| JP | 08308964 | A | * | 11/1996 | |
| JP | 08308965 | A | * | 11/1996 | |
| JP | 10192459 | A | * | 7/1998 | |
| JP | 11-047323 | A | | 2/1999 | |
| JP | 11-047325 | A | | 2/1999 | |
| JP | H-1170191 | | | 3/1999 | |
| JP | 11-089980 | | | 4/1999 | |
| JP | 11089980 | A | * | 4/1999 | |
| JP | 11-137738 | A | | 5/1999 | |
| JP | 11-137741 | A | | 5/1999 | |
| JP | 2000-005355 | A | | 1/2000 | |
| JP | 2000-342726 | A | | 12/2000 | |
| JP | 4351772 | | | 4/2001 | |
| JP | 2003-169870 | | | 6/2003 | |
| JP | 2004-130125 | | | 4/2004 | |
| JP | 2004130125 | A | * | 4/2004 | A63B 53/0487 |
| JP | 2004-329335 | A | | 11/2004 | |
| JP | 2006-167033 | A | | 6/2006 | |
| JP | 2011-194266 | | | 10/2011 | |
| JP | 2011194266 | A | * | 10/2011 | |
| WO | WO 9920358 | | | 4/1999 | |
| WO | WO 9920358 | A1 | * | 4/1999 | A63B 53/04 |

OTHER PUBLICATIONS

U.S. Appl. No. 15/332,864, filed Oct. 24, 2016, Tassitro, et al.
U.S. Appl. No. 15/188,726, filed Jun. 21, 2016, Golden et al.
U.S. Appl. No. 15/182,275, filed Jun. 14, 2016, Ritchie, et al.
U.S. Appl. No. 15/065,104, filed Mar. 9, 2016, Deshmukh, et al.
U.S. Appl. No. 14/589,079, filed Jan. 5, 2015, Deshmukh, et al.
U.S. Appl. No. 14/580,894, filed Dec. 23, 2014, Uday Deshmukh.
Coefficient of Linear Thermal Expansion Data—Repair Engineering.

* cited by examiner

CO-FORGED GOLF CLUB HEAD AND METHOD OF MANUFACTURE

CROSS-REFERENCE TO RELATED APPLICATIONS

The present application is a Continuation (CON) of U.S. patent application Ser. No. 14/580,894, filed on Dec. 23, 2014, which is a Continuation-In-Part (CIP) of U.S. patent application Ser. No. 14/078,380, filed on Nov. 12, 2013, now U.S. Pat. No. 9,387,370, which is a Continuation-In-Part (CIP) of U.S. patent application Ser. No. 13/927,764, filed on Jun. 26, 2013, which is a Continuation-In-Part of U.S. patent application Ser. No. 13/305,087, filed on Nov. 28, 2011, now U.S. Pat. No. 8,926,451, the disclosure of which are all incorporated by reference in their entirety.

FIELD OF THE INVENTION

The present invention relates generally to a co-forged golf club head formed from two or more materials and the method of manufacture for such a golf club head. More specifically, the present invention relates to the creation of an iron type golf club head from a pre-form billet that already contains two or more materials before the actual forging process; resulting in a multi-material golf club head that doesn't require any post manufacturing operations such as machining, welding, swaging, gluing, and the like.

BACKGROUND OF THE INVENTION

Golf is hard! When your average golfer swings a golf club, he or she may have dramatic variations in his or her golf swing, resulting in numerous off-center hits, which result in diminished performance when compared to a direct center hit. However, in an attempt to make this very difficult game more enjoyable for the average golfer, golf club designers have come up with unique golf club designs that will mitigate the harsh realities of a less than perfect golf swing.

In one early example, U.S. Pat. No. 4,523,759 to Igarashi discloses a perimeter weighted hollow golfing iron having a foam core with an effective hitting area concentrated toward the center of moment in an attempt to help make the game of golf easier. Distributing the weight of a golf club to the perimeter allow the moment of inertia (MOI) of a golf club head to be increased, reducing the undesirable twisting a golf club as it impacts a golf ball.

U.S. Pat. No. 4,809,977 to Doran et al. shows another example of an attempt to increase the moment of inertia of a golf club head by placing additional weights at the heel and toe portion of the golf club head. This increase in the moment of inertia of the golf club head achievable by increased heel and toe weighting could further prevent the golf club from twisting in a heel and toe direction, which mitigates the undesirable effect of sending a golf ball off the intended trajectory.

Although the initial attempts at increasing the forgiveness and playability of a golf club for an average golfer are admirable, it does not take advantage of the extreme forgiveness that can be achievable by utilizing different materials to form different portions of the golf club head. In one example, U.S. Pat. No. 5,885,170 to Takeda shows the advantage of using multi-materials to create more extreme adjustment of the mass properties. More specifically, U.S. Pat. No. 5,885,170 teaches a body having a face formed of one material while a hosel is formed from another material having different specific gravity from that of the head body. U.S. Pat. No. 6,434,811 to Helmstetter et al. shows another example of utilization of multiple materials to improve the performance of a golf club head by providing a golf club head with a weighting system that is incorporated after the entirety of the golf club head has been formed.

More recently, the improvements in incorporating multi-materials into a golf club head has matured significantly by incorporating numerous multiple materials of different characteristics by machining cavities into the golf club head. More specifically, U.S. Pat. No. 7,938,739 to Cole et al. discloses a golf club head with a cavity integral with the golf club head, wherein the cavity extends from the heel region to the toe region; extending along a lower portion of the back face of the golf club head; extends approximately parallel to the strike face; and is approximately symmetrical about a centerline that bisects the golf club head between the heel region and the toe region.

However, as multiple materials are introduced into the golf club after the body has been completed, the tolerances of the interfaces between the different materials could potentially cause undesirable side effects of altering the feel of the golf club head. U.S. Pat. No. 6,095,931 to Hettinger et al. identifies this specific undesirable side effect of sacrifice in the feel by the usage of multiple different components. U.S. Pat. No. 6,095,931 addresses this issue by providing an isolation layer between the golf club head and the main body portion that comprises the striking front section.

U.S. Pat. No. 7,828,674 to Kubota recognizes the severity of this problem by stating that hollow golf club heads having viscoelastic element feels light and hollow to the better golfer, hence they do not prefer such a golf club. U.S. Pat. No. 7,828,674 address the deficiencies of such a multi-material golf club by incorporating a block of magnesium to be embedded and or press-fitted into the recess formed in the metal only to be sealed with a metallic cover.

Despite all of the above attempts to improve the performance of a golf club head all while trying to minimize the sacrifice in feel of a golf club, all of the methodologies require a significant amount of post manufacturing operation that creates cavities and recesses in the club head for the secondary material to be incorporated. These type of secondary operations are not only expensive, but the ability to maintain a tight enough tolerance between the various components make is very difficult to maintain the solid feel generally associated with an unitarily formed golf club head.

Hence, it can be seen from above, despite all the development in creating a golf club head that's more forgiving without sacrificing the feel associated with a conventional club head, the current art is incapable of creating such a club without utilizing severe post manufacturing machining that causes bad feel.

BRIEF SUMMARY OF THE INVENTION

In one aspect of the present invention is a forged golf club head comprising a body portion having a striking surface made out of a first material, and at least one weight adjustment portion made out of a second material encased within the body portion; wherein the at least one weight adjustment portion is encased monolithically within the body portion of the golf club head without any secondary attachment operations.

In another aspect of the present invention is a method of forging a golf club head comprising of the steps of creating a cylindrical billet out of a first material, machining one or more cavities within the cylindrical billet, partially filling the one or more cavities with a second material to create a weight adjustment portion, filling the remaining volume of the one or more cavities with the first material to encase the weight adjustment portion, and forging the cylindrical billet to create a body portion of the golf club head; wherein the body portion monolithically encases the weight adjustment portion within a body of the golf club head without any secondary attachment operations.

In another aspect of the present invention is a forged golf club head comprising a body portion having a striking surface made out of first material, and at least one weight adjustment portion made out of a second material encased within the body portion; wherein the at least one weight adjustment portion is encased monolithically within the body portion without any secondary attachment operations. The first material has a first flow stress at a first forging temperature and the second material has a second flow stress at a second forging temperature, wherein the first flow stress and the second flow stress are substantially similar to one another, and the first forging temperature and the second forging temperature are substantially similar to one another and the first forging temperature and the second forging temperature are substantially similar to one another. The first material has a first thermal expansion coefficient and the second material has a second thermal expansion coefficient, wherein the first thermal expansion coefficient is greater than or equal to the second thermal expansion coefficient.

In another aspect of the present invention, the forged golf club head may have a first material has a first thermal expansion coefficient and the second material has a second thermal expansion coefficient, and wherein the first thermal expansion coefficient is greater than or equal to the second thermal expansion coefficient.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
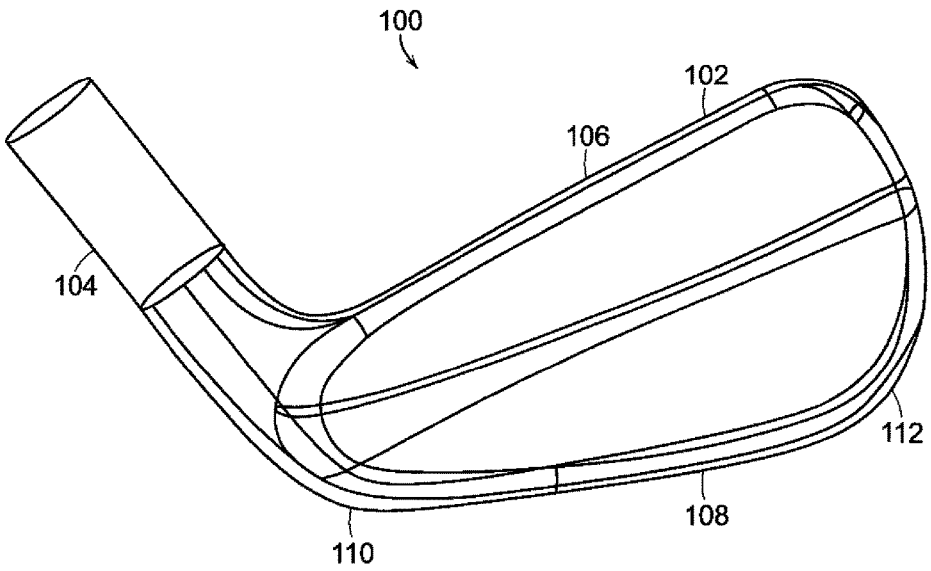
FIG. 1 of the accompanying drawings shows a perspective view of a co-forged golf club head in accordance with an exemplary embodiment of the present invention.

FIG. 1 of the accompanying drawings shows a perspective view of a golf club head 100 in accordance with an exemplary embodiment of the present invention. The golf club head 100 shown in FIG. 1 may generally comprise of a body portion 102 and a hosel portion 104, with the body portion 102 having several individually identifiable components such as a topline portion 106, a sole portion 108, a heel portion 110, and a toe portion 112. The golf club head 100 in accordance with an exemplary embodiment of the present invention may generally be comprised of at least one weight adjustment portion that is encased within the body portion 102 of the golf club head 100. In a preferred embodiment, the weight adjustment portion may be monolithically encased within the body portion 102 to ensure that the weight adjustment portion is secured within the body portion 102 without departing form the scope and content of the present invention. Because the weight adjustment portion is monolithically encased within the body portion 102 of the golf club head 100, these weights are not visible in FIG. 1 of the accompanying drawings. However, these weight adjustment portions will be shown in more detail in later figures, when various different views are presented.

Before moving onto subsequent figures, it is worthwhile here to emphasize that the current golf club head 100 is created using a forging process and the weights are incorporated without any post finish machining operations. This is an important distinction to establish because the same result of a monolithically encasing a weight adjustment portion is extremely difficult to achieve using alternative manufacturing processes such as casting. "Monolithically encased", as referred to in the current patent application, may generally be defined as a having a specific internal component placed inside a separate external component without joints or seams in the finished product. With respect to the current invention, having weight adjustment portions "monolithically encased" within the body portion 102 of the golf club head 100 may generally refer to the ability to have weight adjustment portions placed inside the body portion 102 of the golf club head without joints or seams that are generally required by post manufacturing processes such as milling, welding, brazing, gluing, or swaging.

It should also be noted here that a weight that is "monolithically encased" within the current definition of the present invention could potentially have certain aspect of the internal weights exposed in the finish product to illustrate the existence of a weight adjustment portion without departing from the scope and content of the present invention. More specifically, "monolithically encased" refers to the methodology used to create the ultimate product as described above, and may not necessarily be limited to visually concealing the weight adjustment portion.

FIGS. 2A-2D illustrate the methodology used to create a co-forged golf club head 200 in accordance with an exemplary embodiment of the current invention. More specifically, FIGS. 2A-2D illustrate the steps involved in the forging of a golf club head from its rudimentary billet 201 shape into the final product of a golf club head 200.

Figure 2D:
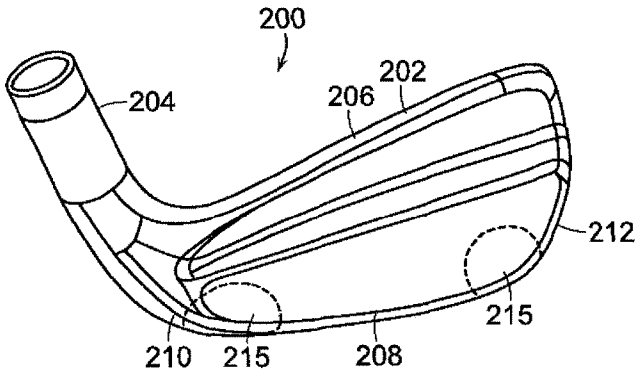
FIGS. 2A-2D shows perspective views of pre-formed billets used to create a golf club head in accordance with an exemplary embodiment of the present invention.
Figure 2A:
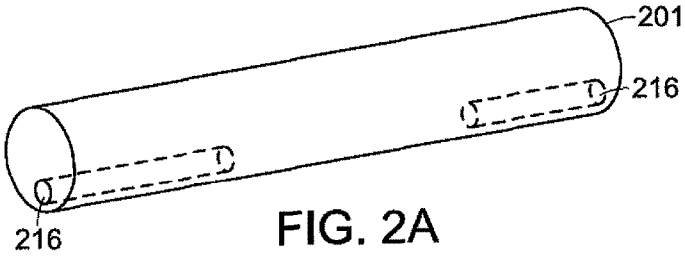

FIG. 2A shows a pre-formed billet 201 in accordance with an exemplary embodiment of the present invention. As it can be seen from FIG. 2A, the pre-form billet 201 may generally begin as a cylindrical rod formed from a first material, as it is common with the forging of a golf club head 200. In order to create a weight adjustment portion 215 that can be monolithically encased within the body portion 202 of the golf club head 200, one or more cavities 216 are machined into the pre-form billet 201. In this current exemplary embodiment shown in FIG. 2A, two cavities 216 are machined into the terminal ends of the pre-form billet 201. The location and geometry of the cavities 216 within the pre-form billet 201 are important, as it correlates directly with the ultimate location of the weight adjustment portion 215 in the golf club head 200 after forging.

Figure 2B:
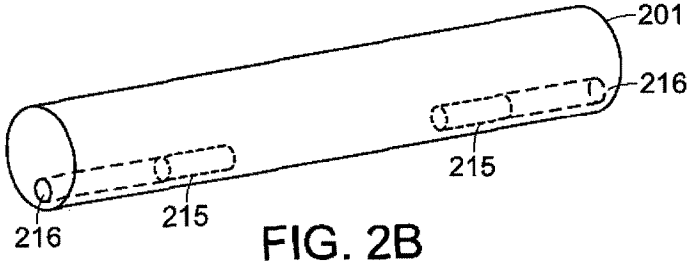

Moving onto FIG. 2B, it can be seen that once the cavities 216 are machined, the cavities 216 are partially filled with a second material that has a density different from the density of the first material in order to create the weight adjustment portion. 215. Similar to the discussion above, the location, size, and shape of the weight adjustment portion 215 is just as critical as the location, size, and shape of the cavities 216, as the weight adjustment portion 215 within the pre-form billet 201 correlates with the ultimate resting place of the weight adjustment portion 215 in the golf club head.

Figure 2C:
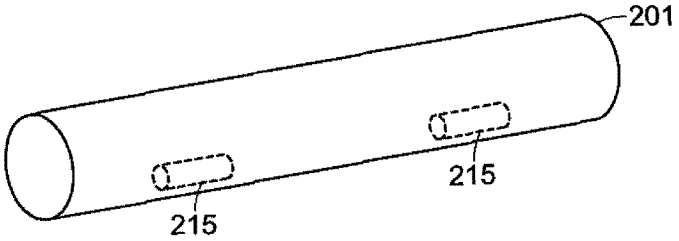

Finally, FIG. 2C shows the final phase of the pre-form billet 201 as the remaining volume of the cavities 216 are filled with the first material and sealed through traditional joining methods such as welding, brazing, and swaging. Sealing the cavities 216 allows the weight adjustment portion 215 to be monolithically encased within the body of the pre-form billet 201, which will allow the same weight adjustment portion 215 to be monolithically encased in the body 202 of the golf club head 200 after the forging process. After the cavities 216 are filled, the pre-form billet 201 is subjected to the normal forging process associated with the forging of a golf club head 200. Although the basic steps involved in forging a golf club head 200 are important to the understanding of the current invention, it involves a relatively archaic and established technique, which the present application will not dive into much detail. More information regarding the steps involved in the forging of a basic golf club head without monolithically encased weight adjustment portions can be found in U.S. Pat. No. 3,825,991 to Cornell, and U.S. Pat. No. 6,666,779 to Iwata et al., the disclosure of which are all incorporated by reference in its entirety.

Although the above discussion regarding the forging of a golf clubs incorporated by reference do a good job describing the actual forging process, it fails to address the additional concerns with the co-forging process of the current invention wherein two different materials are involved in this forging process. More specifically, because a weight adjustment portion 215 is made out of a second material that could be different from the first material used to create remainder of the pre-form billet 201, special care must be taken to ensure that the different materials can be forged together to form a golf club head 200. Hence, in order to select two cohesive materials that are capable of being co-forged together, the first material and the second material may generally have to have very specific material properties requirements with respect to their flow stress and their thermal expansion coefficient. Although it is most preferential for the two materials to have identical material properties yielding in consistency in forging, the usage of identical materials may not offer any weight adjustment benefits required for the basis of the current invention.

First of, in order for metallic materials to have the capabilities of being co-forged together, the respective flow stress' of each of the materials needs to be properly considered. Flow stress of a material, may generally be defined as the instantaneous value of stress require for continued deforming the material (i.e. to keep the metal flowing); and the creation of a cohesive forged component from two different materials will require them to flow at relatively the same speed when subjected to the stresses of the forging process. It is commonly known that the flow stress of a material is generally a function of the yield strength, the flow stress of a material may generally be summed up by Eq. (1) below.

$$Y_f = Ke^n \quad \text{Eq. (1)}$$

wherein $Y_f$=Flow Stress (MPa)

K=Strain Coefficient (MPa)

N=Strain Hardening Exponent

In addition to the above equation, it is worthwhile to mention here that the flow stress of a material may not be construed in vacuum, but rather, it is a function of the forging temperature of the material as well. Hence, in a current exemplary embodiment of the present invention, a first flow stress of the first material at its first forging temperate is substantially similar but not identical to the second flow stress of the second material at its second forging temperature; with the first forging temperature and the second forging temperature being substantially similar. More specifically, in a more detailed embodiment, the first material may be 1025 steel having a first flow stress of about 10 ksi (kilo-pound per square inch) at a forging temperature of about 1,200° C., while the second material may a Niobium material having a second flow stress of also about 12 ksi at a forging temperature of about 1,100° C.

Although in the exemplary embodiment of the present invention described above, the first material may be a 1025 steel and the second material may be a Niobium material, various other materials may also be used without departing from the scope and content of the present invention so long as their flow stresses are similar at a similar forging temperature. Alternatively speaking, any two materials may be used in the current co-forging process so long as the second flow stress is no more than 20% greater or no less than 20% lesser than the first flow stress.

As mentioned before, other than flow stress, the thermal expansion coefficient of the first and second materials are also important to the proper co-forging of two distinct materials. More specifically, a first thermal expansion coefficient of the first material may generally need to be greater than or at least equal to the second thermal expansion coefficient of the second material. Because the thermal expansion coefficient also relate to the shrinkage of the material after forging, it is important that the first material that monolithically encases the second material have a higher thermal expansion coefficient to prevent gaps from forming at the interface portion of the materials. In a more detailed embodiment of the present invention, the first material may be 1025 steel having a thermal expansion coefficient of about 8.0 μin/in ° F., while the second material may be Niobium having a second thermal expansion coefficient of about 3.94 μin/in ° F.

It should be noted that although in the above exemplary embodiment the second thermal expansion coefficient is smaller than the first thermal expansion coefficient, the numbers can be identical to achieve perfect mating of the two materials without departing from the scope and content of the present invention. In fact, in one exemplary embodiment of the present invention, it may be preferred for the first material and the second material to have the same thermal expansion coefficient, as excessive shrinkage of the outer material upon the inner material could potentially create additional stresses at the interface portions of the two materials.

Alternatively, in an attempt to provide different weighting characteristics, the second material could be made out of a 6-4 Titanium material to reduce the weight of the weight adjustment portion 215. The Titanium material may generally have a flow stress of about 10 ksi at a forging temperature of about 1,100 ° C. and a thermal expansion coefficient of about 6.1 μin/in ° F.

Now that the forging process, and the specific concerns involving the co-forging of different materials have been discussed, FIG. 2D of the accompanying drawings shows a perspective view of a finished golf club head 200 created using the co-forging process above, wherein the golf club head 200 monolithically encases at least one weight adjustment portion 215 within the body portion 202. More specifically, in the current exemplary embodiment of the present invention, the weight adjustment portions 215 are placed near a heel portion 210 and a toe portion 212 of the golf club head 200. The placement of the weight adjustment portion 215 near a heel portion 210 and the toe portion 212 allow the golf club head 200 to have an increase in the Moment of Inertia (MOI) without the need for any secondary attachment operations; which will result in a more consistent feel upon impact with a golf ball.

Before moving onto a discussion regarding different embodiments of the present invention, it is worthwhile here to note that the exact placement of the weight adjustment portion 215 within the body portion 202 of the golf club head 200 is slightly different in every single different club head, this is the outcome of the current inventive co-forging process involves different materials. More specifically, the exact placement of the weight adjustment portion 215 may differ with each single golf club 200, as the flow stress of the first material and the second material will help determine the final location of the weight adjustment portion 215. In addition to the above, it should be noted that the interface between the weight adjustment portion 215 and the body portion 202 of the golf club head 200 may generally be an irregular interface, with the boundaries jagged to indicate that the entire golf club head 200 has been co-forged. This is dramatically different from a cavity created via a post machining secondary operations such as milling and drilling; which generally have clean bifurcation lines of the two different materials.

FIGS. 3A-3D of the accompanying drawings shows an alternative embodiment of the present invention wherein two separate weight adjustment portions 314 and 315 are placed at different portions of the pre-form billet 301 to create a golf club head 300 with a different performance criteria. More specifically, the golf club head 300 shown in FIG. 3D may have a lightweight weight adjustment portion 314 near a topline portion 306 of the golf club head 300 and a heavyweight weight adjustment portion 315 near a sole 308 of the golf club head 300 to help shift the Center of Gravity (CG) of the golf club head 300 lower to help with launch and spin characteristics of the current inventive golf club head 300.

Figure 3D:
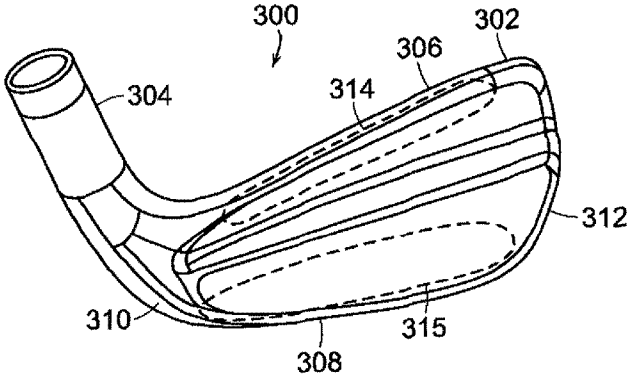
FIGS. 3A-3D shows perspective views of pre-formed billets used to create a golf club head in accordance with an exemplary embodiment of the present invention.
Figure 3A:
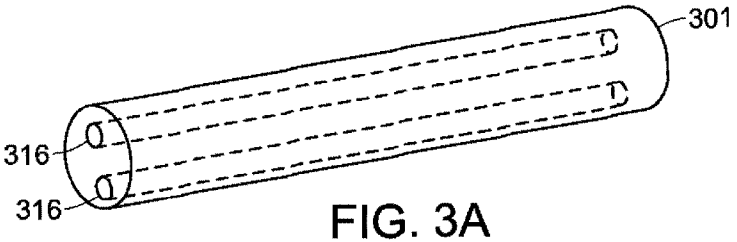
Figure 3B:
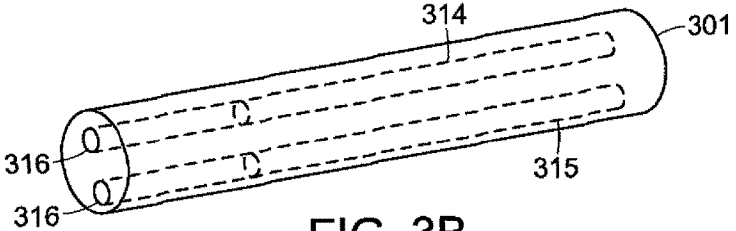
Figure 3C:
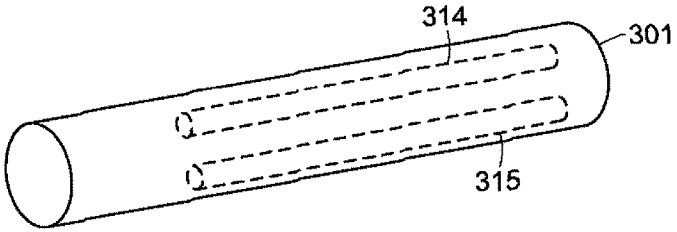
Figure 4D:
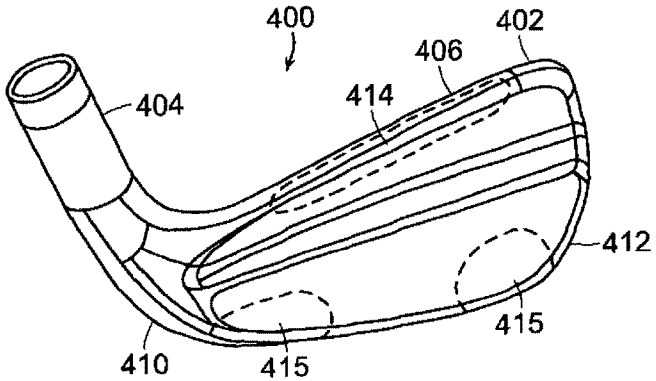
FIGS. 4A-4D shows perspective views of pre-formed billets used to create a golf club head in accordance with an exemplary embodiment of the present invention.
Figure 4A:
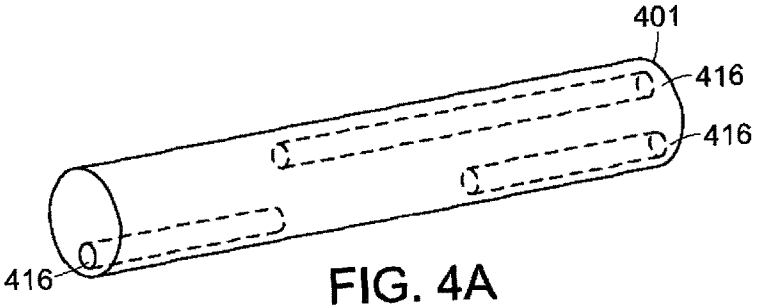
Figure 4B:
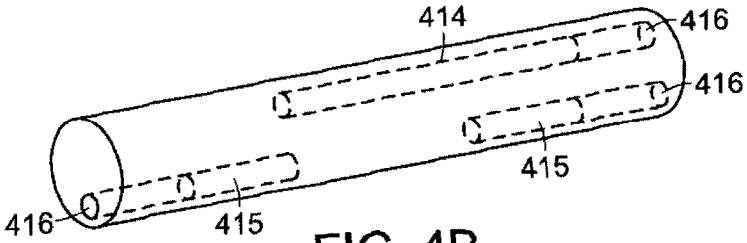
Figure 4C:
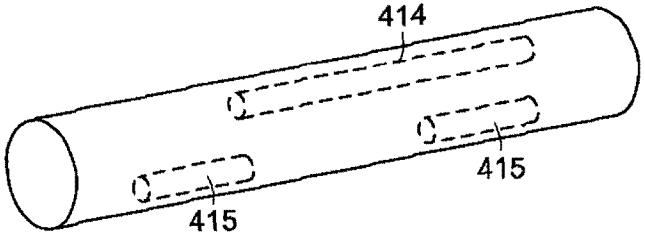

FIG. 3A-3C, similar to before, show the formation process of the current inventive golf club head 300, starting from a pre-form billet 301. More specifically, FIG. 3A shows a perspective view of a pre-form billet 301 in accordance with an exemplary embodiment of the present invention wherein a plurality of cavities 316 are drilled at strategic locations within the billet 301. It should be noted that in this current exemplary embodiment the plurality of cavities 316 are drilled near a top portion and a bottom portion of the pre-form billet 301 instead of at each of the terminal ends, as this specific embodiment focuses on lowering the CG of the golf club head 300 by removing weight from the top line portion 306 of the golf club head 300 and shifting it towards a sole portion 308 of the golf club head 300.

FIG. 3B of the accompanying drawings shows two weight adjustment portions 314 and 315 being placed inside the cavities 316 created in FIG. 3A. Although it may generally be desirable to minimize the weight near a top portion of a golf club head 300 when one desires to lower the CG, top cavity 316 can not be left completely blank in this current embodiment of the present invention, as the entire pre-form billet 301 will eventually be forged into the shape of a golf club head 300, causing any empty cavity 316 to collapse upon itself. Hence, in this current exemplary embodiment of the present invention, the top cavity 316 may be filled with a lightweight weight adjustment portion 314, while the lower cavity 316 may be filled with a heavyweight weight adjustment portion 315. The lightweight weight adjustment portion 314 may generally be made out of a third material having a third density, wherein the heavyweight weight adjustment portion 315 may generally be made out of second material having a second density. In one exemplary embodiment of the present invention, the third density may generally be less than about 7.0 g/cc, wherein the second density may generally be greater than about 7.8 g/cc; while the first material used to form the body portion 302 of the golf club head 300 may generally have a first density of about 7.8 g/cc.

FIG. 3C of the accompanying drawings shows the final stage of the pre-form billet 301 that has monolithically encased the weight adjustment portions 314 and 315 within the internal cavities 316 of the pre-form billet 301. More specifically, the creation of the pre-form billet shown in FIG. 3C involves filling in the remaining volume of the cavities 316 with a first material to encase the weight adjustment portions 315 and 316 within the pre-form billet 301. Similar to the above discussion, the pre-form billet 301, is subsequently forged to create a golf club head 300 as shown in FIG. 3D, wherein the weight adjustment portions 314 and 315 are monolithically encased within the body portion 302 of the golf club head 300.

Similar to the methodology described above, the co-forging of the third material within the cavity created within the first material, the third material may generally need to have a third flow stress that is similar with the first flow stress of the first material and a third thermal expansion coefficient less than the first thermal expansion coefficient of the first material. More specifically, in one exemplary embodiment of the present invention, the third material may be a 6-4 Titanium material having a third flow stress of about 10 ksi at a forging temperature of about 1,100 ° C. and a third thermal expansion coefficient of about 6.1 μin/in ° F.

Although FIGS. 2A-2D and FIGS. 3A-3D show different embodiments of the present invention used to achieve a higher MOI and a lower CG respectively, these features are not mutually exclusive from one another. In fact, in a further alternative embodiment of the present invention shown in FIGS. 4A-4D, features may be taken from both embodiments discussed above to create a co-forged golf club head with a higher MOI as well as a lower CG all without departing from the scope and content of the present invention. More specifically, in FIGS. 4A-4D, the steps needed to incorporate a lightweight weight adjustment portion 414 near a top portion 406 of a golf club 400 together with two or more heavyweight weight adjustment portions 415 near a toe portion 412 and a heel portion 410 of the golf club head 400 to create a golf club with higher MOI and a lower CG.

FIG. 5A-5D of the accompanying drawings shows a further alternative embodiment of the present invention wherein the body portion 502 of the golf club head 500 may be comprised of a monolithically encased weight adjustment portion 514. In this current exemplary embodiment of the present invention, the weight adjustment portion 514 may be relatively large in size, allowing it to replace a majority of the body portion 502 of the golf club head 500 once the forging process is completely. In this current exemplary embodiment of the present invention, the monolithically encased weight adjustment portion 514 may generally be made out of a third material having a third density that is significantly lower than the first density of the first material used to form the body portion 502 of the golf club head 500; allowing weight to be taken out from the body portion 502 of the golf club head 500. Because the lightweight third material used to form the weight adjustment portion 514 may generally be relatively soft compare to the first material, it is generally desirable to monolithically encase the weight adjustment portion 514 within the internal body of the golf club head 500, allowing significant weight savings to be achieved without sacrificing feel.

Figure 5D:
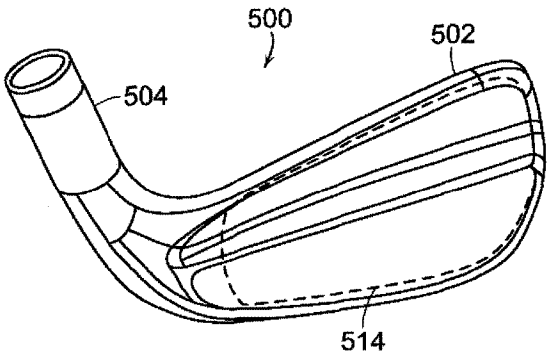
FIGS. 5A-5D shows perspective views of pre-formed billets used to create a golf club head in accordance with an exemplary embodiment of the present invention
Figure 5A:
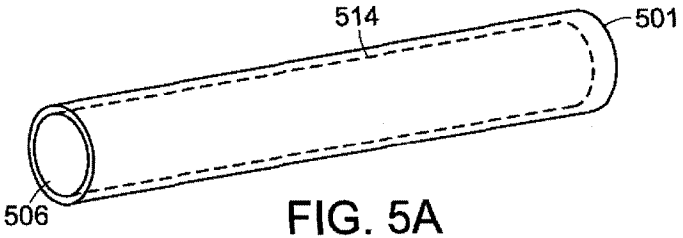
Figure 5B:
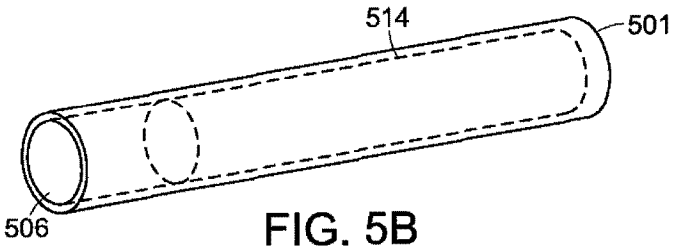
Figure 5C:
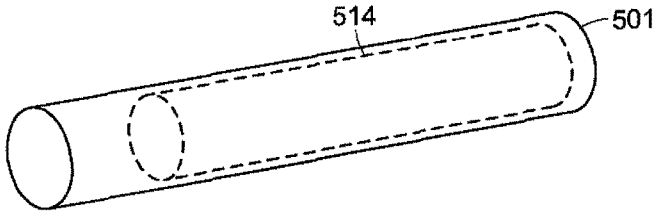

More specifically FIG. 5A of the accompanying drawings shows a pre-form billet 501 similar to the previous figures. However, in this current exemplary embodiment, the cavity 506 is significantly larger within the pre-form billet 501 itself. This large cavity 506 can then be used in FIG. 5B to be filled with a weight adjustment portion 514 to adjust the weight, density, and overall feel of the golf club head 500. In FIG. 5C, similar to described above, the remaining volume of the cavity 516 is filled with the original first material before the entire pre-form billet 501 is subjected to the forging process to create a golf club head 500.

It is worth noting here that in this current exemplary embodiment, the hosel portion 504 of the golf club head 500 is deliberately made from the conventional first material, as the bending characteristics of the second material used to form the weight adjustment portion 514 may generally not be suitable for the bending requirements of an iron type golf club head 500. More specifically, the third material used to form the weight adjustment portion 514 could be a lightweight iron-aluminum material having a density of less than about 7.10 g/cc, more preferably less than about 7.05 g/cc, and most preferably less than about 7.00 g/cc, all without departing from the scope and content of the present invention. However, numerous other materials can also be used as the third material used to form the weight adjustment portion 514 without departing from the scope and content of the present invention so long as the third material has a density within the range described above.

Figure 6:
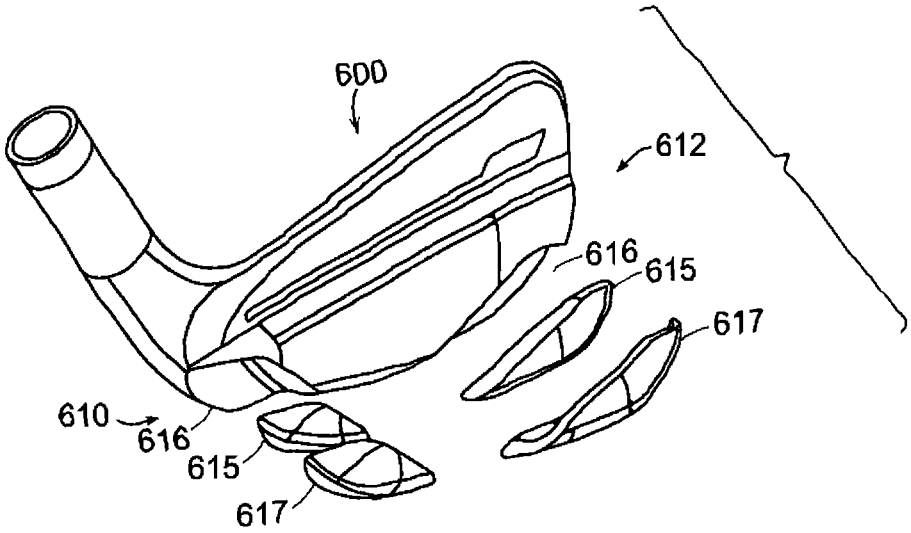
FIG. 6 shows an exploded rear perspective view of a golf club head created using a multi-step co-forging method in accordance with a further alternative embodiment of the present invention.

FIG. 6 of the accompanying drawings shows an exploded rear perspective view of a golf club head 600 in accordance with a further alternative embodiment of the present invention utilizing a multi-step co-forging process. This multi-step co-forging process, the details of which will be described subsequently in FIGS. 8-14, allows for an improvement in the ability to precisely place different weight members within different parts of the golf club head 600. This improvement in the ability to precisely place weighting members not only opens the door to allow multiple different materials to be forged together that were previously impossible due to their inherent material limitations, but it also allows for more improvements in the performance characteristics of a golf club 600 than previously discussed.

More specifically, FIG. 6 of the accompanying drawings shows a co-forged golf club head 600 created using the multi-step co-forging process. The golf club head 600 have heavier density weight adjustment portions 615 at the heel 610 and toe 612 portion of the golf club head 600 corresponding to their respective cavities 616. The weight adjustment portions 615 are then combined with caps 617 to retain the weight adjustment portions 615 together with the body of the golf club head 600 during the co-forging process. It should be noted that the current exemplary golf club head 600 utilizes a multi-step co-forging process to install the heavy weight adjustment portions 615 without the need of post manufacturing finishes such as welding, brazing, swaged, or the like. As previously mentioned, the benefit of utilizing such a co-forged process is the uniformity and consistency of the material, resulting in superior performance and feel. However, in addition to the benefit articulated above, the current embodiment of the present invention allows the heavy weight adjustment portions 615 to be placed at the extremities of the golf club head 600, further improving the center of gravity location as well as the moment of inertia of the golf club head 600.

Figure 7:
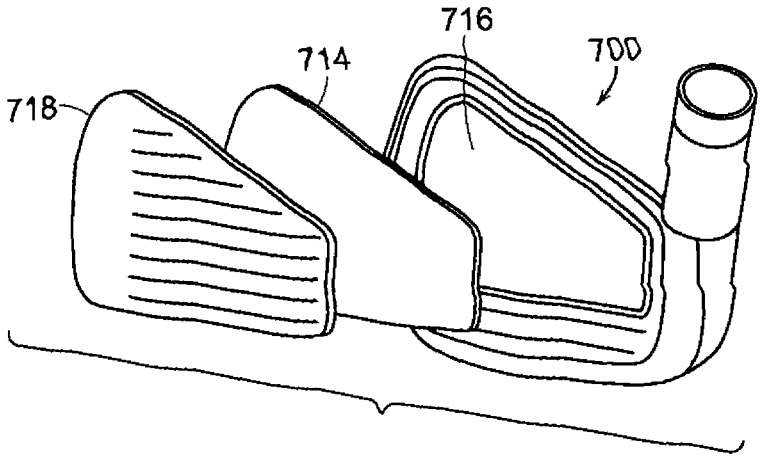
FIG. 7 shows an exploded frontal perspective view of a golf club head created using a multi-step co-forging method in accordance with a further alternative embodiment of the present invention.

FIG. 7 of the accompanying drawings shows an exploded frontal perspective view of a golf club head 700 in accordance with a further alternative embodiment of the present invention. More specifically, golf club head 700 incorporates a lightweight weight adjustment portion 714 behind a striking face 718 portion of the golf club head 700 within a cavity 716 in a multi-step co-forging process. In this current exemplary embodiment of the present invention, due to the precision co-forging process discussed above, the location and placement of the lightweight weight adjustment portion 714 can be more precisely placed, hence creating the opportunity to reduce weight from the striking face 718 portion of the golf club head 700. In order to understand the current multi-step co-forging process, FIGS. 8-14 have been presented below, detailing the steps involved in this multi-step co-forging process.

Figure 8:
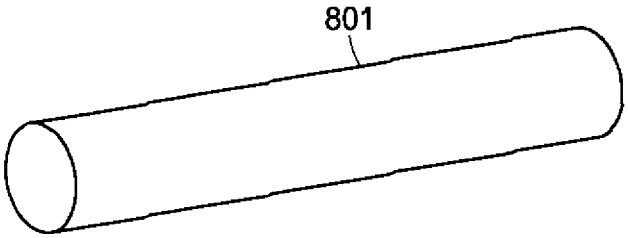
FIG. 8 shows a pre-formed billet used in a multi-step co-forging method to create a golf club head in accordance with an alternative embodiment of the present invention.
Figure 9:
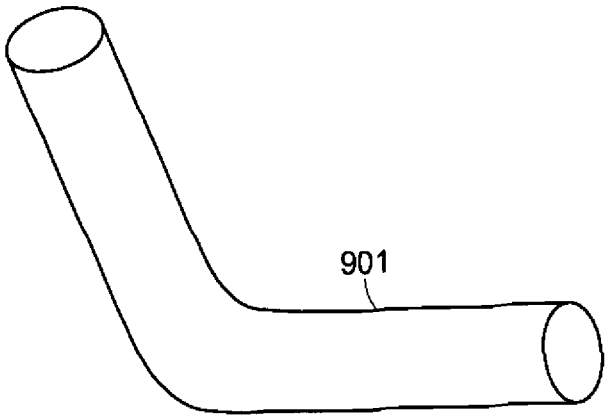
FIG. 9 shows a bent pre-formed billet during one of the multi-step co-forging process in accordance with an alternative embodiment of the present invention.
Figure 10B:
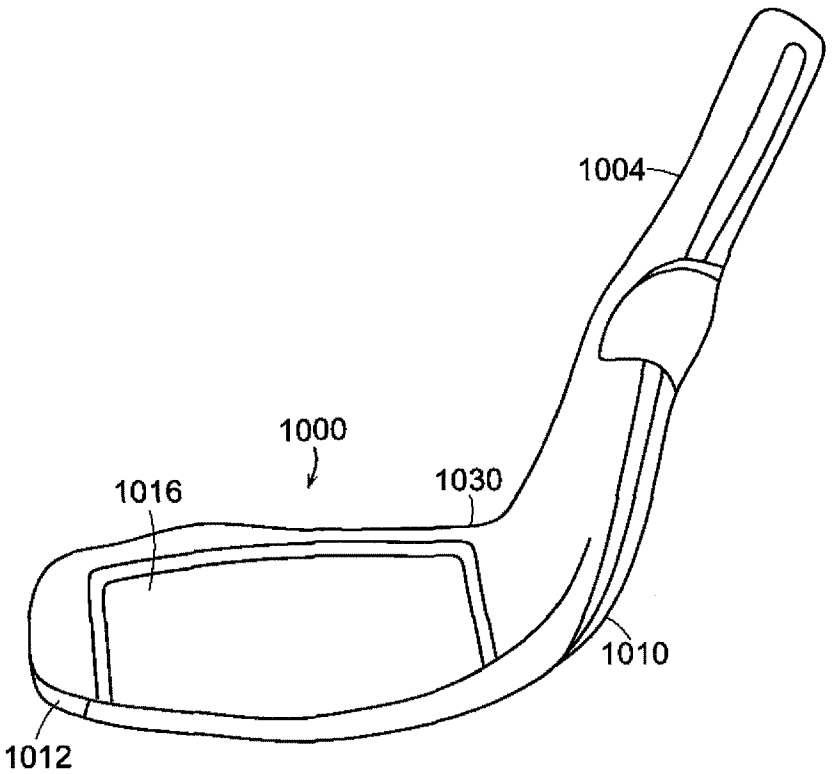
FIGS. 10*a* and 10*b* shows a rear and frontal view of a golf club head during one of the multi-step co-forging process in accordance with an alternative embodiment of the present invention.
Figure 10A:
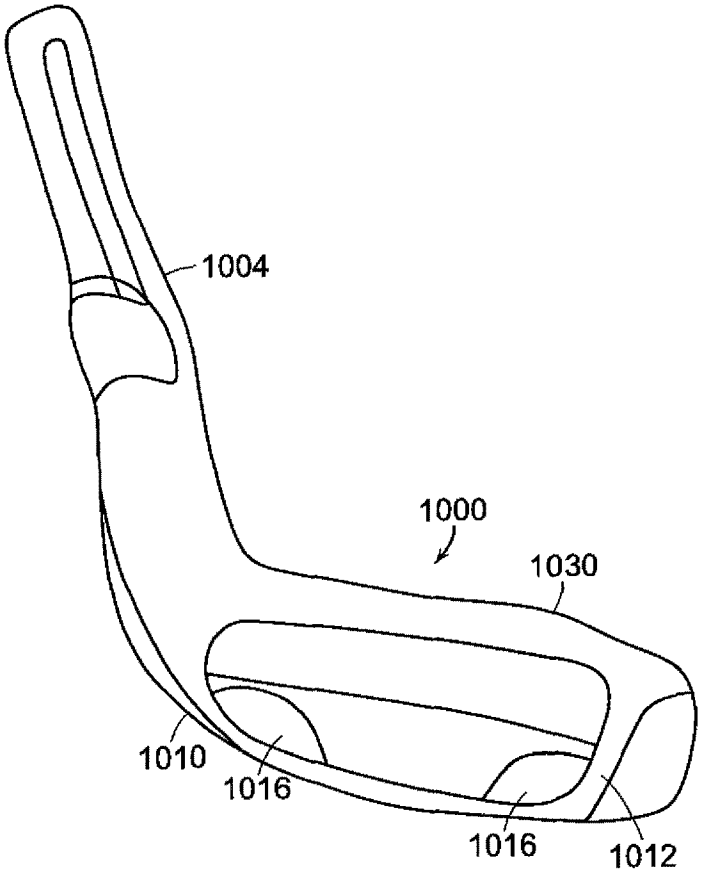

FIG. 8 of the accompanying drawings, similar to FIGS. 2-5 above, show a preform billet 801 used to create a forged golf club head. This forged billet 801, is then bent to an L-shape as shown in FIG. 9 to prepare the billet 901 for the die that begins the forging process. FIGS. 10*a* and 10*b* shows the frontal and rear view of a golf club head 1000 that's been subjected to the first step of the multi-step co-forging process. In this preliminary step, the billet has been forged to a shape that roughly resembles that of a golf club head 1000. In fact, even in this early stage, the shape of the golf club 1000 can be seen, as it already has a hosel portion 1004, a heel portion 1010, and a toe portion 1012. In the rear view of the golf club head 1000 shown in FIG. 10*a*, preliminary imprints of the cavity 1016 can already be seen in the heel 1010 and toe 1012 portion of the golf club head; while in the frontal view of the golf club head 1000 shown in FIG. 10*b*, the cavity 1016 can already be seen near the striking face.

Subsequent to the initial forging step, the excess trim 1030 may be removed from the golf club head 1000 and subsequent to that, subjected to another rough forging step. During the forging process, the excess material may flow outside of the confines of the die, resulting in what is commonly known as "flash". This flash material, as previously discussed, may be trimmed off in between the individual multi-forging steps to improve the adherence to the die in subsequent steps.

Figure 11B:
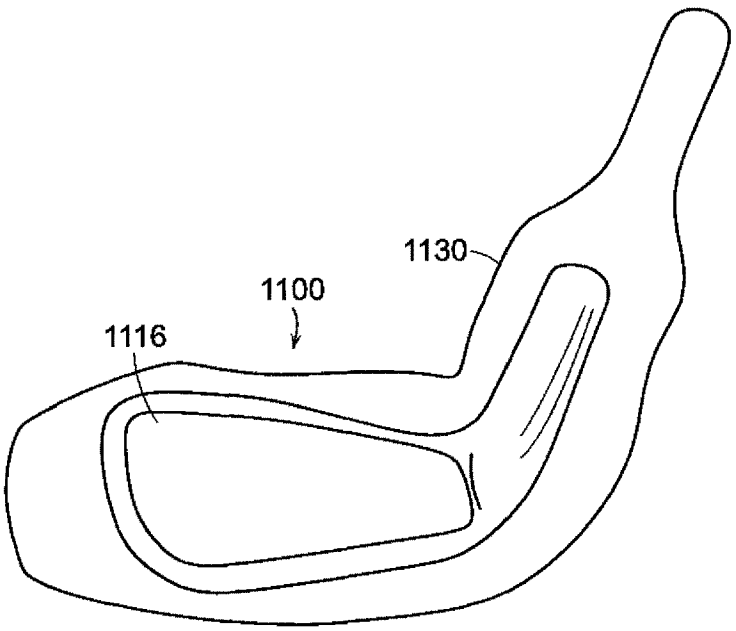
FIG. 11*a* and 11*b* shows a rear and frontal view of a golf club head during one of the multi-step co-forging process in accordance with an alternative embodiment of the present invention.
Figure 11A:
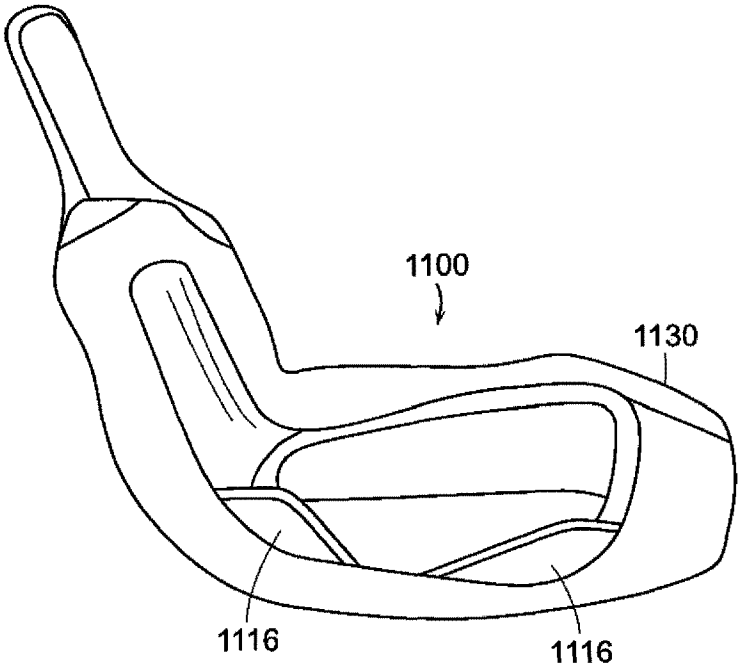

The results of this secondary forging step can be shown in FIGS. 22*a* and 11*b*. As it can be seen from FIGS. 11*a* and 11*b*, the golf club head 1100 in this current state, is starting to take on a shape that more closely resembles that of a finished product. In addition to the overall shape being more defined, the boundaries and shapes of the cavities 1116 are also starting to take on their respective shape as well. Subsequent to this secondary forging step, the weight adjustment portions can be added into the specific cavities 1116 before the golf club head 1100 is subjected to the final forging step.

Figure 12B:
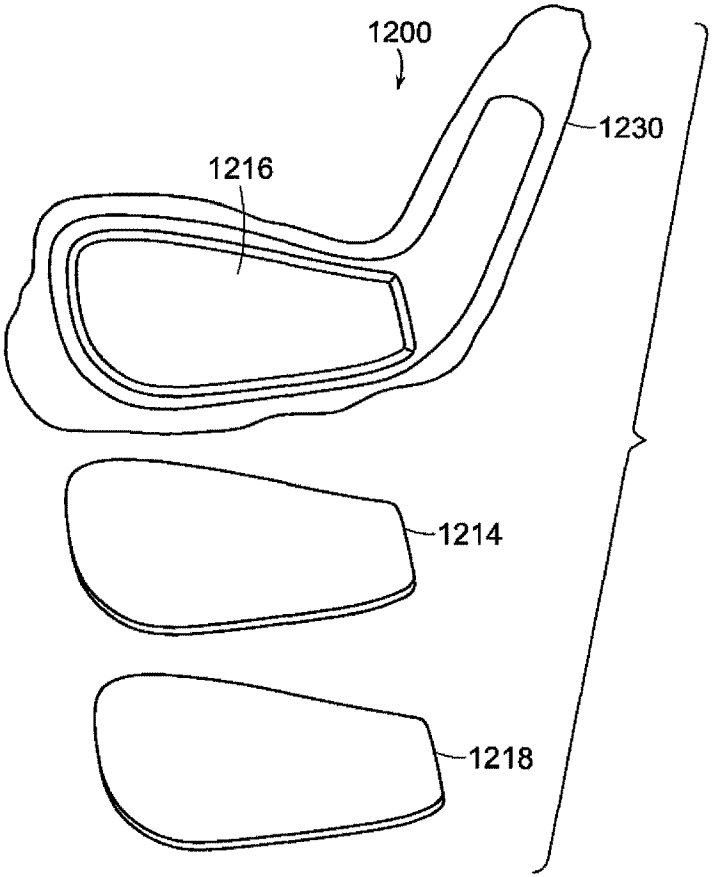
FIGS. 12*a* and 12*b* shows a rear and frontal exploded view of a golf club head during one of the multi-step co-forging process in accordance with an alternative embodiment of the present invention.
Figure 12A:
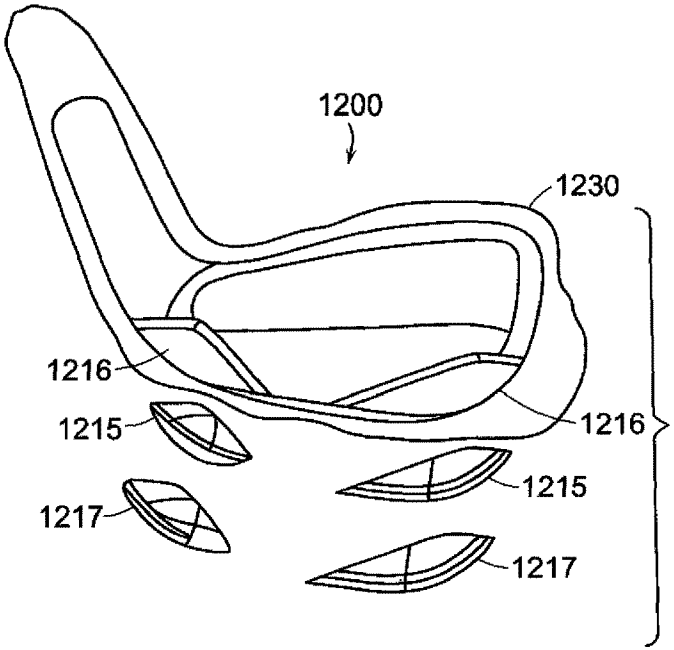

The relationship between the weight adjustment portions to the cavities 1116 on the golf club head 1100 can be shown more clearly in FIGS. 12*a* and 12*b*. Here, in FIGS. 12*a* and 12*b*, it can be seen that the cavity 1216 on the rear portion of the golf club head 1200 may be filled with weight adjustment portions 1215 that may generally have a higher density than the body of the golf club head 1200. The high density weight adjustment portions 1215 may then be covered up with a cap 1217 made out of a similar material as the body of the golf club head 1200, allowing high density weight adjustment portions 1215 to be retained within the cavity 1216. In the front of the golf club head 1200, the cavity 1216 may be filled with a weight adjustment portion 1214 having a lower density than the body portion of the golf club head 1200. Similar to the rear, this weight adjustment portion 1214 may be secured in the cavity 1216 with a cap like mechanism that also serves as a striking face 1218. The striking face 1218, similar to the cap 1217, may be made out of a similar material as the body of the golf club head 1200. Having the cap 1217 and the striking face 1218 be made out of the same material as the remainder of the body of the golf club head 1200 is beneficial because it allows these two components to be welded to the body portion of the golf club head 1200. Having these components welded in place allows the weight adjustment portions 1215 to be secured within their own respective cavities 1216 before the final forging step that completes the current multi-step co-forging process.

In an alternative embodiment of the present invention, the cap 1217 may not even be necessarily needed to completely cover up the cavity 1216 and the weight adjustment portion 1214. In fact, in an alternative embodiment of the present invention, the cap 1217 only needs to partially cover the weight adjustment portion 1215 to a degree that sufficiently prevents the weight adjustment portion 1215 from separating from the body of the golf club head 1200.

Figure 13B:
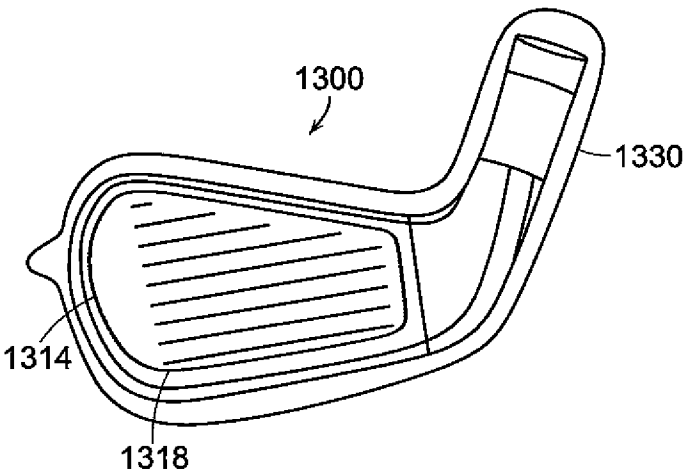
FIGS. 13*a* and 13*b* shows a rear and frontal view of a golf club head during one of the multi-step co-forging process in accordance with an alternative embodiment of the present invention.
Figure 13A:
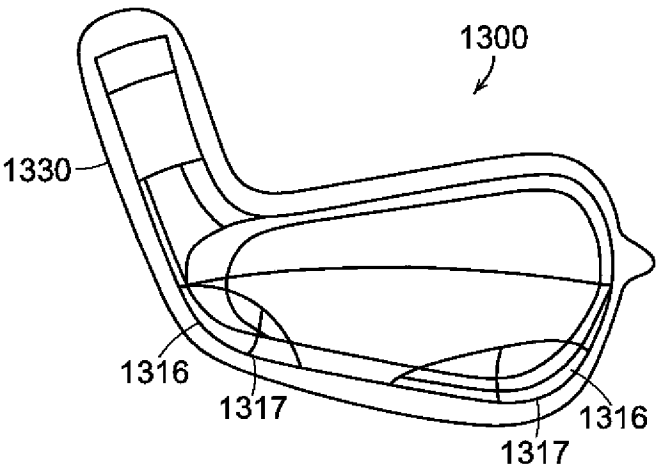

The final forging process involved in this process is generally creates a golf club head 1200 that can be considered "co-forged", as now the golf club head 1200 contains two or more different materials being forged together in this final step. FIGS. 13*a* and 13*b* show the results of the golf club head 1300 after it has completed the final co-forging step. In its current state, the golf club head 1300 has taken its final shape, and the weight adjustment portions 1316 and 1314 are all now monolithically enclosed within their respective cavities by the caps 1317 and striking face plate 1318. Although the golf club head 1300 may have taken their form, there are still excessive flash 1330 around the perimeter of the golf club head 1300 that needs to be trimmed before the golf club head 1300 takes its final form.

Figure 14B:
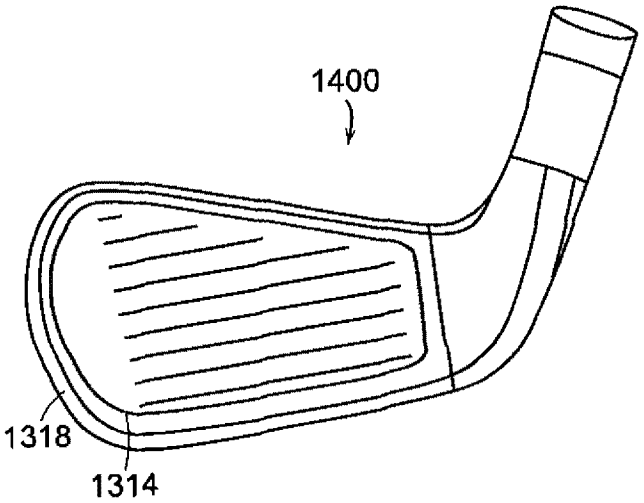
FIGS. 14*a* and 14*b* shows a rear and frontal view of a finished golf club head after the multi-step co-forging in accordance with an alternative embodiment of the present invention.
Figure 14A:
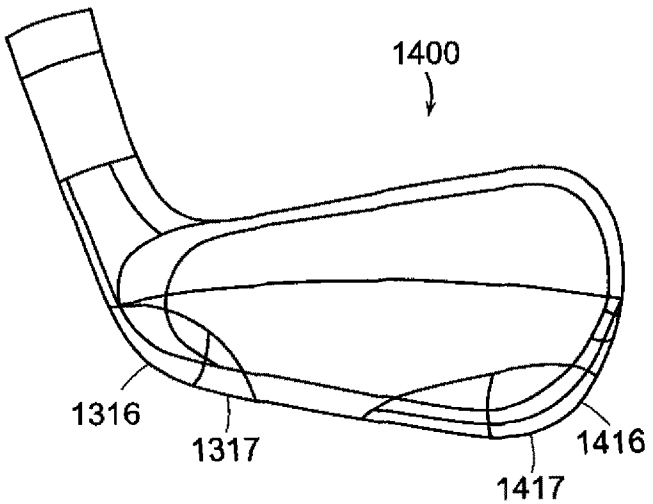

FIGS. 14*a* and 14*b* show the completed golf club head 1400 as a result of this co-forging process. As it can be seen here in FIGS. 14*a* and 14*b*, the excess flash 1330 has already been trimmed, improving the aesthetic appeal of the golf club head 1400. As previously mentioned, as a result of this co-forging process, the weight adjustment portions 1416 and 1418 are seamlessly and monolithically encased with the body of the golf club head 1400 via the cap 1417 and the striking face plate 1318. As previously discussed, the advantage of having the weight adjustment portions 1416 seamlessly and monolithically encased with the body of the golf club head 1400 via this co-forged process is that it prevents rattling, and improves the solid feel of the golf club head 1400. In fact, utilizing this process, the present golf club head can achieve a feel that is almost non-discernible from a unitary forged golf club head utilizing conventional forging methodologies.

Alternatively speaking, it can also be said that this present multi-step co-forging methodology creates a unique relationship between the weight adjustment portions 1416 and 1418 and the cavity 1216 (see FIG. 12) that it sits in. More specifically, it can be said that the outer surface area of the weight adjustment portion 1416 may generally be identical to the inner surface area of the cavity 1216. The cavity 1216 may generally include the surface area of any caps 1217 or face plate 1218 used to complete the cavity 1216 created by the rough forging steps. (See FIG. 12) Although the symmetry in shape and surface area between the cavity 1216 and the weight adjustment portion 1416 may not appear like an innovative achievement initially, the reality of the situation is that unless a co-forged step is involved, such a seamless interface between the two components are impossible to achieve. Given the bonding constraints of the materials used for different parts of the golf club head, the current innovative co-forging method is the only way to achieve such a seamless interface between these components.

Figure 15:
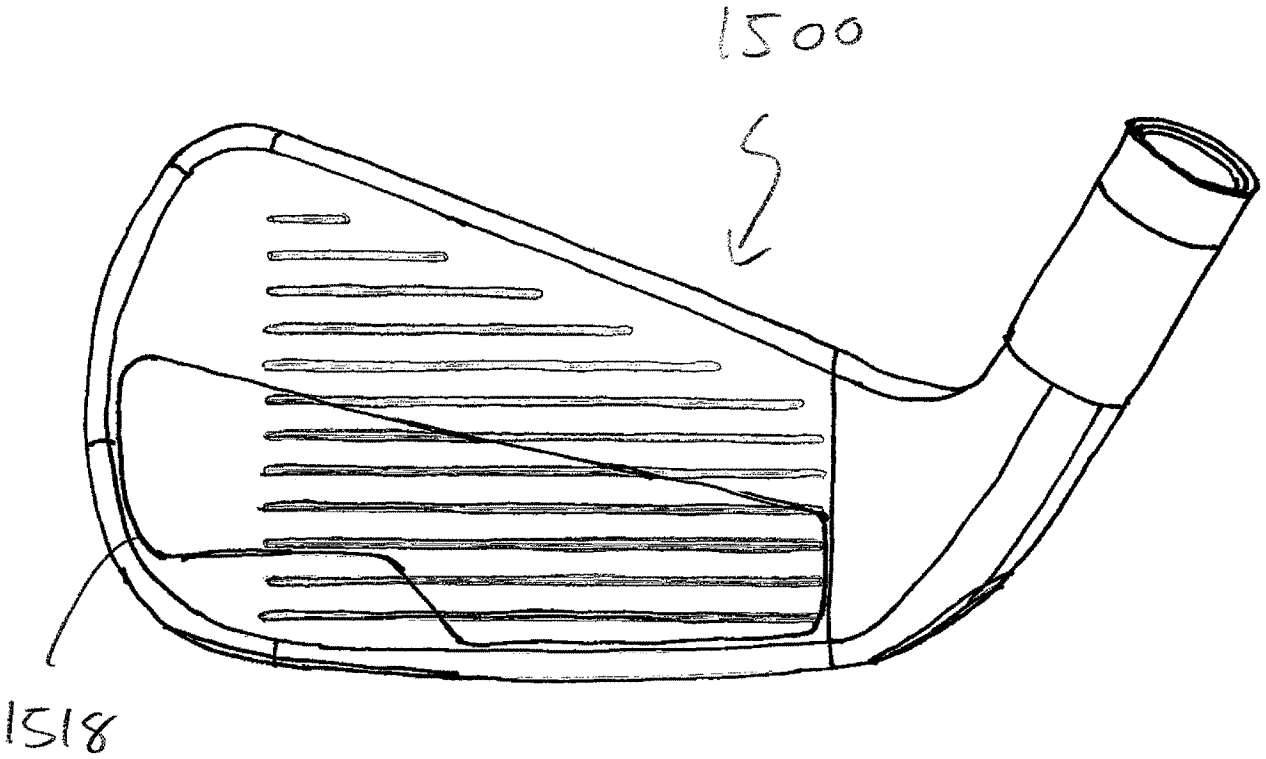
FIG. 15 shows a frontal view of a golf club head in accordance with an alternative embodiment of the present invention.

FIG. 15 of the accompanying drawings shows a frontal view of a finished product golf club head 1500 in accordance with an alternative embodiment of the present invention utilizing the co-forged technology previously described. In this embodiment, the striking face insert 1518 may only partially cover the lower portion of the golf club head 1500, allowing a cavity to be created only in the lower portion of the golf club head 1500. This specific bifurcation of the club head 1500 may be beneficial in improving the performance of the golf club head 1500 in creating a dual cavity design that provides structural support near the central hemisphere of the club head 1500 to provide a more solid feel during impact.

Figure 16:
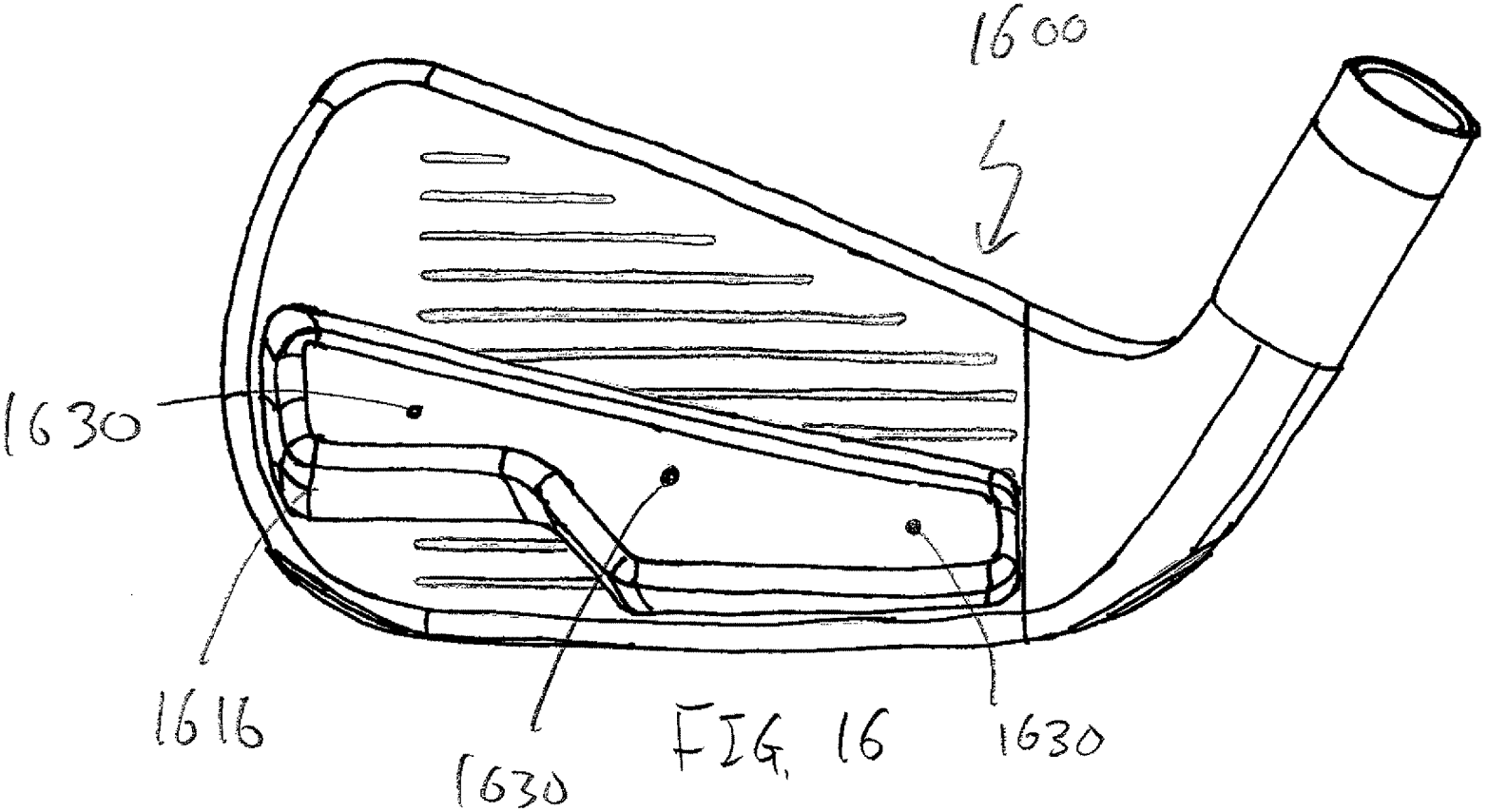
FIG. 16 shows a frontal view of a golf club head in accordance with an alternative embodiment of the present invention without the striking face showing a cavity.

FIG. 16 of the accompanying drawings shows a frontal view of a golf club head 1600 without the striking face insert 1518 (shown in FIG. 15). This view of the golf club head 1600 allows the internal face cavity 1616 to be shown more clearly, illustrating a plurality of support rods 1630 that may be used to further provide structural support to the striking face portion. In one embodiment, the plurality of rods 1630 may be circular rods as shown in FIG. 16 dispersed throughout the internal walls of the face cavity 1616. However, in other embodiments, the plurality of rods 1630 may not even be cylindrical, but be square, rectangular, or any other shape all without departing from the scope and content of the present invention so long as it is provides any sort of localized support for the striking face. In addition to the variation in the geometry of the rods 1630, the placement of the rods 1630 need not be dispersed throughout the internal walls of the face cavity 1616, in fact, the location of the rods 1630 may be placed at any one of many numerous locations all without departing from the scope and content of the present invention. Finally, it should be noted that in an alternative embodiment of the present invention, the face cavity 1616 may not even require any supporting rods 1630, and the face cavity 1616 may be entirely hollow without departing from the scope and content of the present invention.

Figure 17:
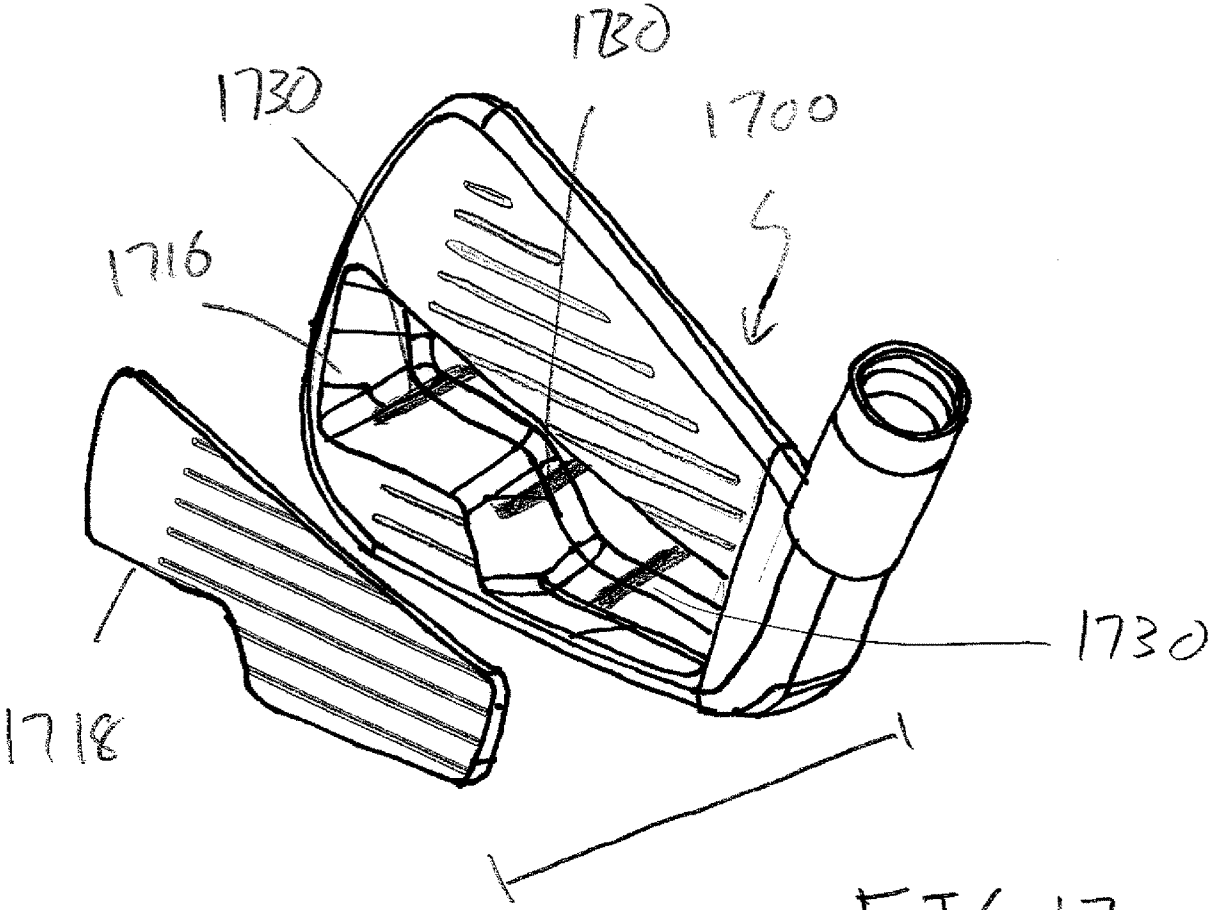
FIG. 17 shows a perspective exploded view of a golf club head in accordance with an alternative embodiment of the present invention.

FIG. 17 of the accompanying drawings shows an exploded perspective view of a golf club head in accordance with the embodiment of the present invention shown in FIGS. 15 and 16. More specifically, this exploded view allows the relationship and fit between the striking face insert 1718 and the face cavity 1716 of the golf club head 1700 to be shown more clearly. It should be noted that although the earlier discussion talk about using a co-forged process to join together different metals that cannot be easily welded together, the connection between the striking face insert 1718 and the body of the golf club head 1700 involves a hollow face cavity 1716 portion that could cause the striking face insert 1718 to deform during a forging process. Luckily, in the current embodiment, the material used for the striking face insert 1718 may be similar to that of the body portion 1700, allowing the two components to be joined together using a conventional welding process after the other components are co-forged together.

Another feature worth identifying is the length of the plurality of rods 1730. The plurality of rods 1730, in order to provide structural support to the striking face insert 1718, may generally touch the rear surface of the striking face insert 1718. Alternatively speaking, it can be said that the terminal ends of the plurality of rods 1716 may contact a rear surface of the striking face insert 1718 to provide the structural enhancement. However, in an alternative embodiment, the terminal ends of the plurality of rods 1716 may terminate just short of the rear surface of the striking face insert 1718 creating a gap; promoting face flexure upon impact with a golf ball while creating a backstop to preserve the elastic deformation of the striking face insert 1718 material.

Figure 18:
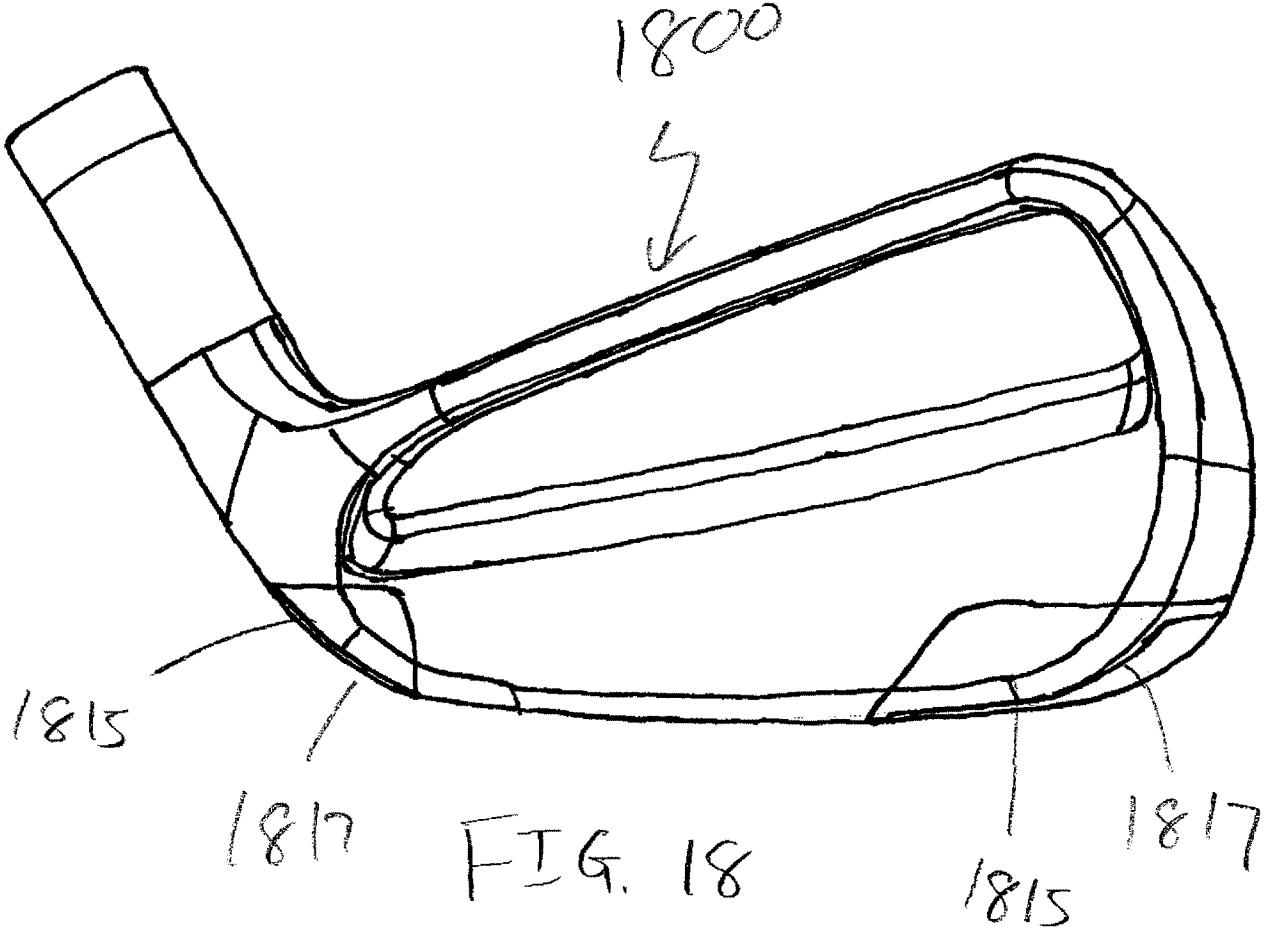
FIG. 18 show a back view of a golf club head in accordance with an alternative embodiment of the present invention.

FIG. 18 of the accompanying drawings shows a back view of a golf club head 1800 having one or more weights 1815 and caps 1817 joined together using the co-forged process described above. Without repeating the process described above, FIGS. 19-20 will show a toe and heel exploded view of the various components that will be created using the co-forged process described above.

Figure 19:
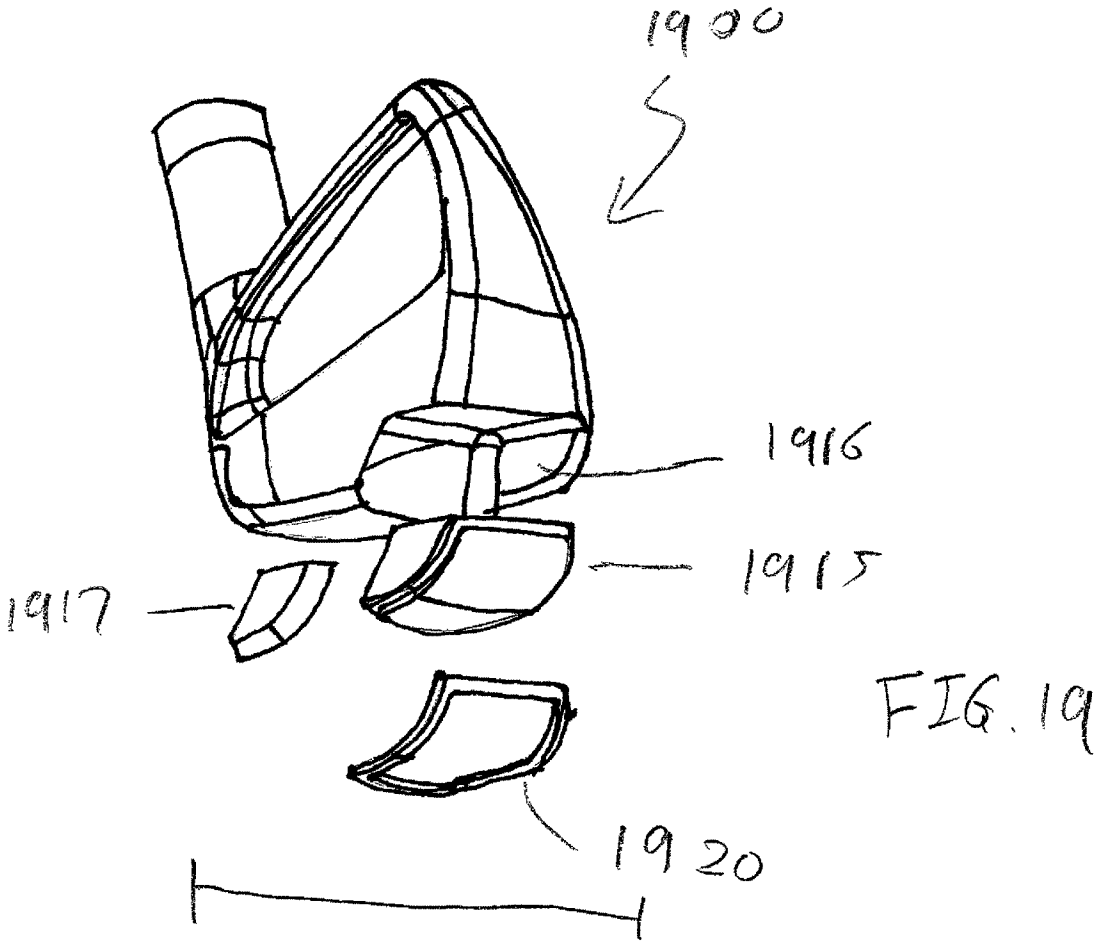
FIG. 19 shows a toe side exploded view of a golf club head in accordance with an alternative embodiment of the present invention.

FIG. 19 shows an exploded toe perspective view of a golf club head 1900 illustrating the various components of the weighting system in accordance with this embodiment of the present invention. The exploded view of the golf club head 1900 is not illustrative of the methodology used to create the weighting system, but rather is only presented here to illustrate how the components could be used together in the co-forging process described above to create the golf club head 1900. More specifically, the weighting system here comprises a weight cavity 1916, a weight 1915, a cap 1979, and welding material 1920. The weight cavity 1916 is formed here in the rough forging step, after which the weight 1915 is tack welded within the weight cavity 1916 with the cap 1917 using the welding material 1920. After the various components are roughly connected to one another, the entire golf club head 1900 is subjected to a final forging step as described above in FIGS. 13*a* and 13*b*.

Figure 20:
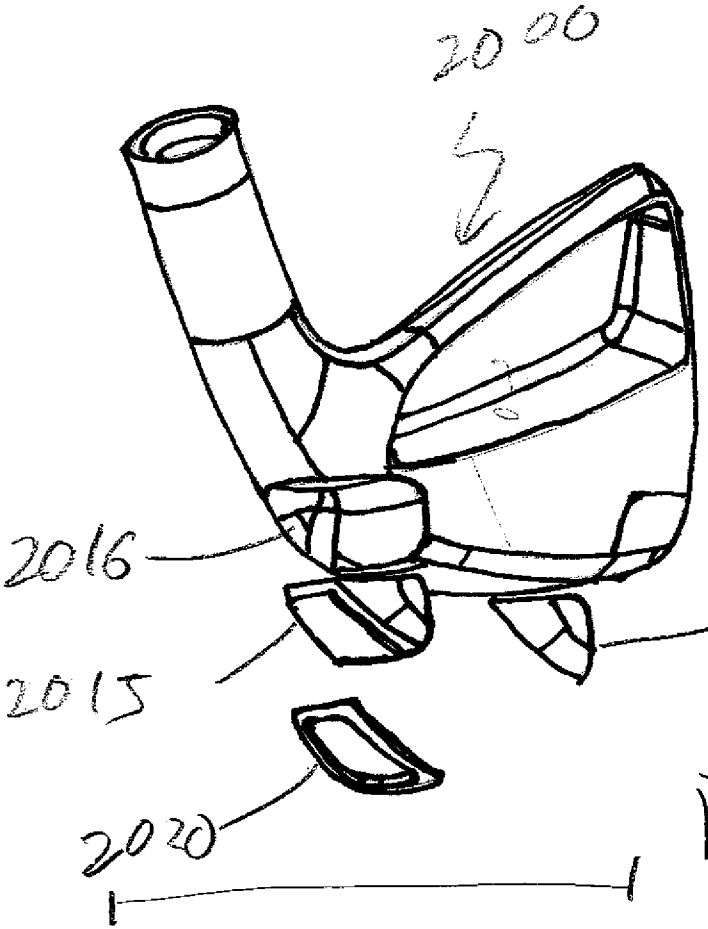
FIG. 20 shows a heel side exploded view of a golf club head in accordance with an alternative embodiment of the present invention.

FIG. 20 shows an exploded heel perspective view of a golf club head 2000 illustrating the various components of the weighting system in accordance with this embodiment of the present invention. Similar to the discussion above for FIG. 19, this view is provided to illustrate the relationship between the components.

In addition to above, the current multi-step co-forging process may differ from the pure co-forging process in that it no longer requires the two materials to have similar flow stresses between the different materials. This elimination of the requirement that the material needs to have similar flow stresses may be beneficial because it allows a wider range of materials to be used, especially when it comes to exotic materials providing extreme weighting benefits such as Tungsten. The current multi-step co-forging process is capable of achieving this by forging the cavity for the weight before using a final cap type material to fill the gap around the cavity to completely enclose the weight adjustment portion within the cap type material. Despite the elimination of the need for the materials to have similar flow stress, the need for the second material to have a smaller thermal expansion coefficient as the first material still stands true in this multi-step co-forging process. This requirement still stands because the second material, although encompassed in a cavity via a cap, is still subjected to the same forging temperature as the external first material. Any excessive expansion of the second material would degrade the structural rigidity of the cap, causing potential failures in the bonding process.

Figure 21:
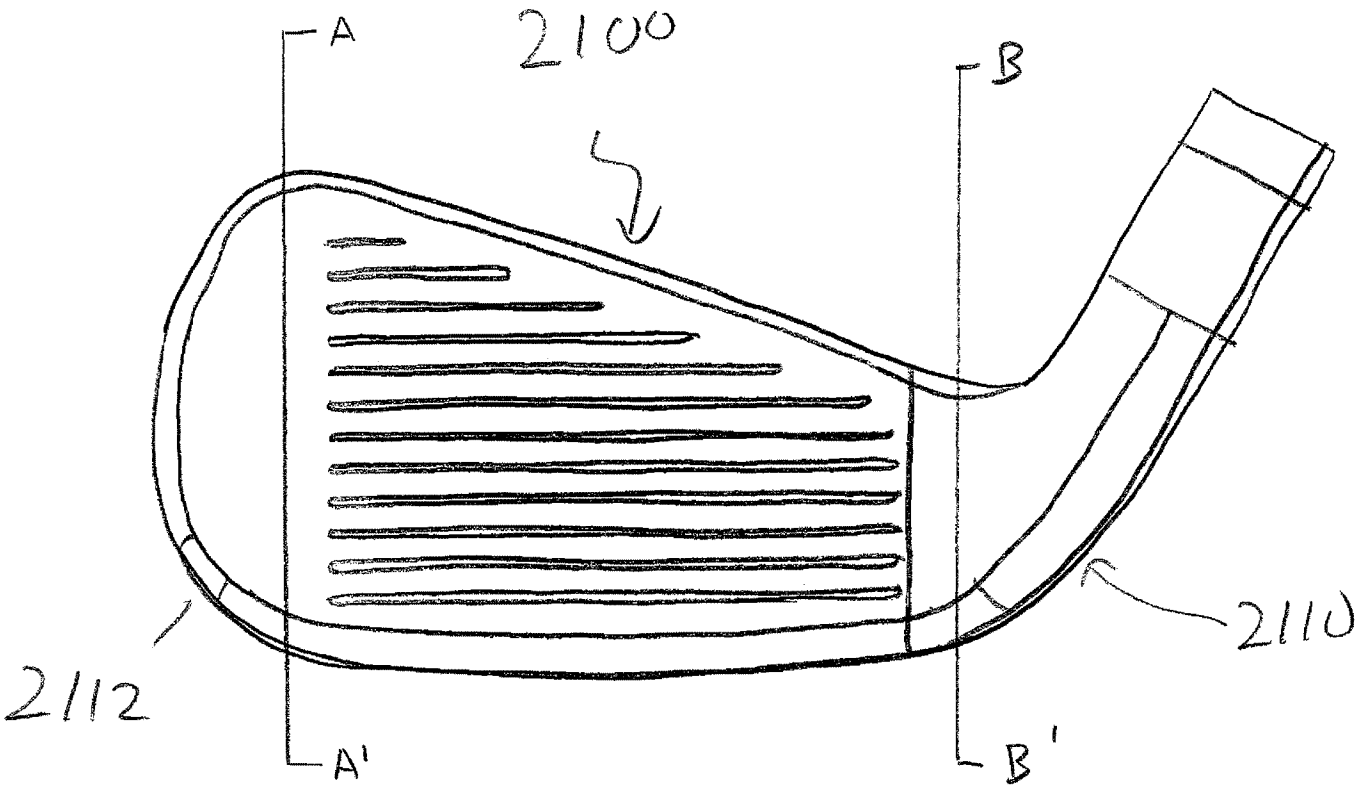
FIG. 21 shows a frontal view of a golf club head in accordance with an embodiment of the present invention allowing cross-sectional lines A-A' and B-B' to be shown.

FIG. 21 of the accompanying drawings shows a frontal view of a golf club head 2100 in accordance with an alternative embodiment of the present invention. FIG. 21 also shows cross-sectional lines A-A' and B-B' that cuts through the weight adjustment portion (not shown) of the golf club head 2100. In this embodiment of the present invention, the weight adjustment portion may have one or more indentations to allow for better bonding between the different materials during a co-forging process. To better illustrate the interaction between the weight adjustment portion, one or more indentations, and the body of the golf club head 2100, FIGS. 22 and 23 are provided.

Figure 22:
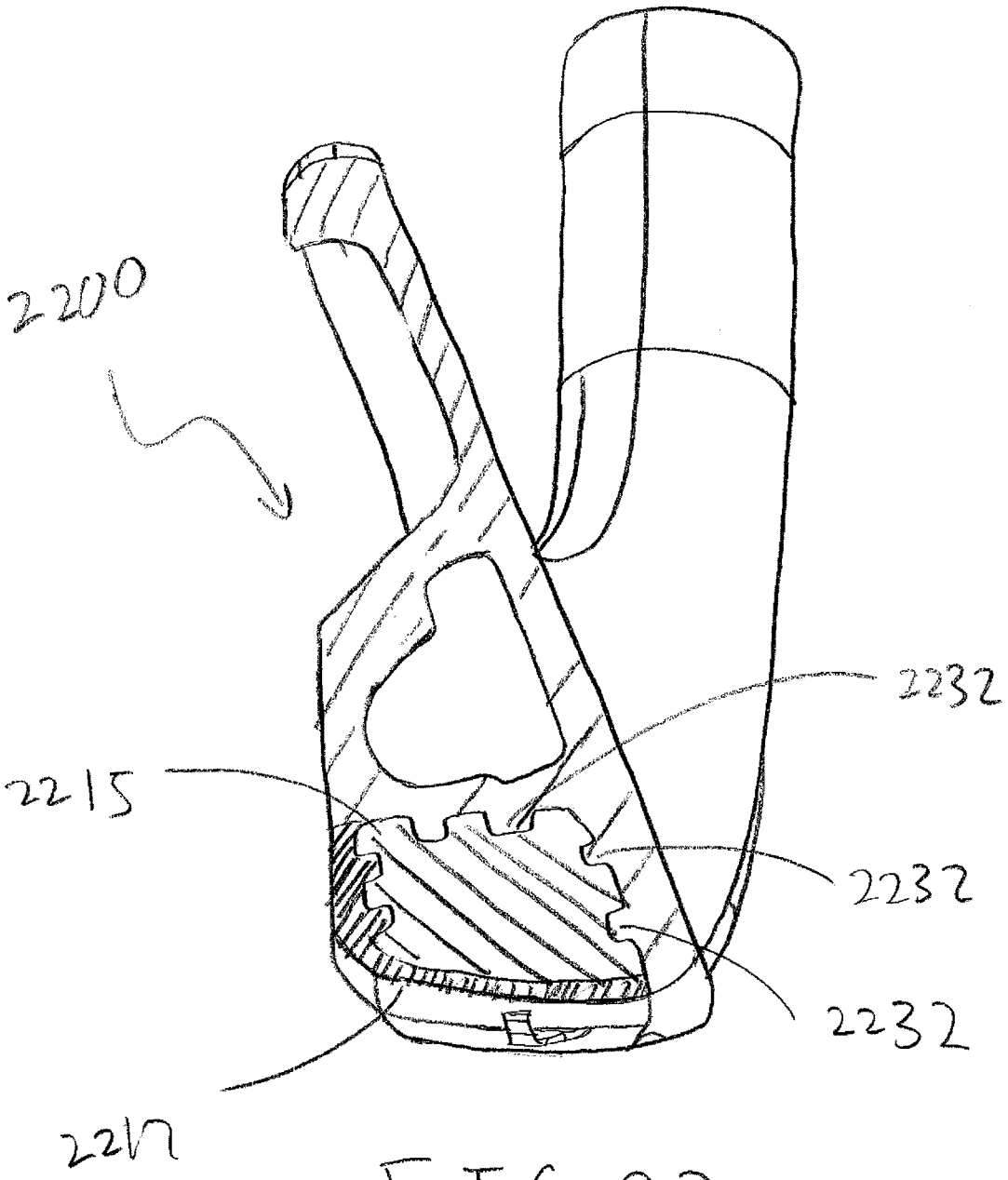
FIG. 22 shows a cross-sectional view of a golf club head in accordance with an embodiment of the present invention along cross-sectional line A-A'.

FIG. 22 providing a cross sectional view of the golf club head 2200 along cross-sectional line A-A' as shown in FIG. 21. The current cross-sectional view of the golf club head 2200 shows a weight adjustment portion 2215 enclosed by a cap 2217 attached to the golf club head 2200. It should be noted that in this current exemplary embodiment of the present invention, the interface between the weight adjustment portion 2215 and the body portion of the golf club head 2200 may comprises of one or more indentations 2232. These indentations 2232 may be notches, grooves, depressions, or even textured surfaces all without departing from the scope and content of the present invention. It is important to recognize here that these indentations 2232, although may appear trivial at first glance, are important to improve the bonding between the weight adjustment portion 2215 and the body of the golf club head 2200 in the current co-forged construction methodology. Because co-forging of the weight adjustment portion 2215 to the body portion of the golf club head 2200 may require some change in the physical properties of the material, having such indentations 2232 will help create a better bond than as if the surfaces are completely smooth. Alternatively speaking, it can be said that the weight adjustment portion 2215 may further be comprised of one or more indentations 2232.

In the current embodiment shown in FIG. 22, the indentations 2232 could be incorporated onto the top side, the front side, and the back side of the weight adjustment portion 2215 to help improve the bonding between the two components. However, in alternative embodiments of the present invention, the indentations 2232 could be placed on any combination of the top, the bottom, the front, and the back portions depending on where the bonding tends to be weak, all without departing from the scope and content of the present invention.

Figure 23:
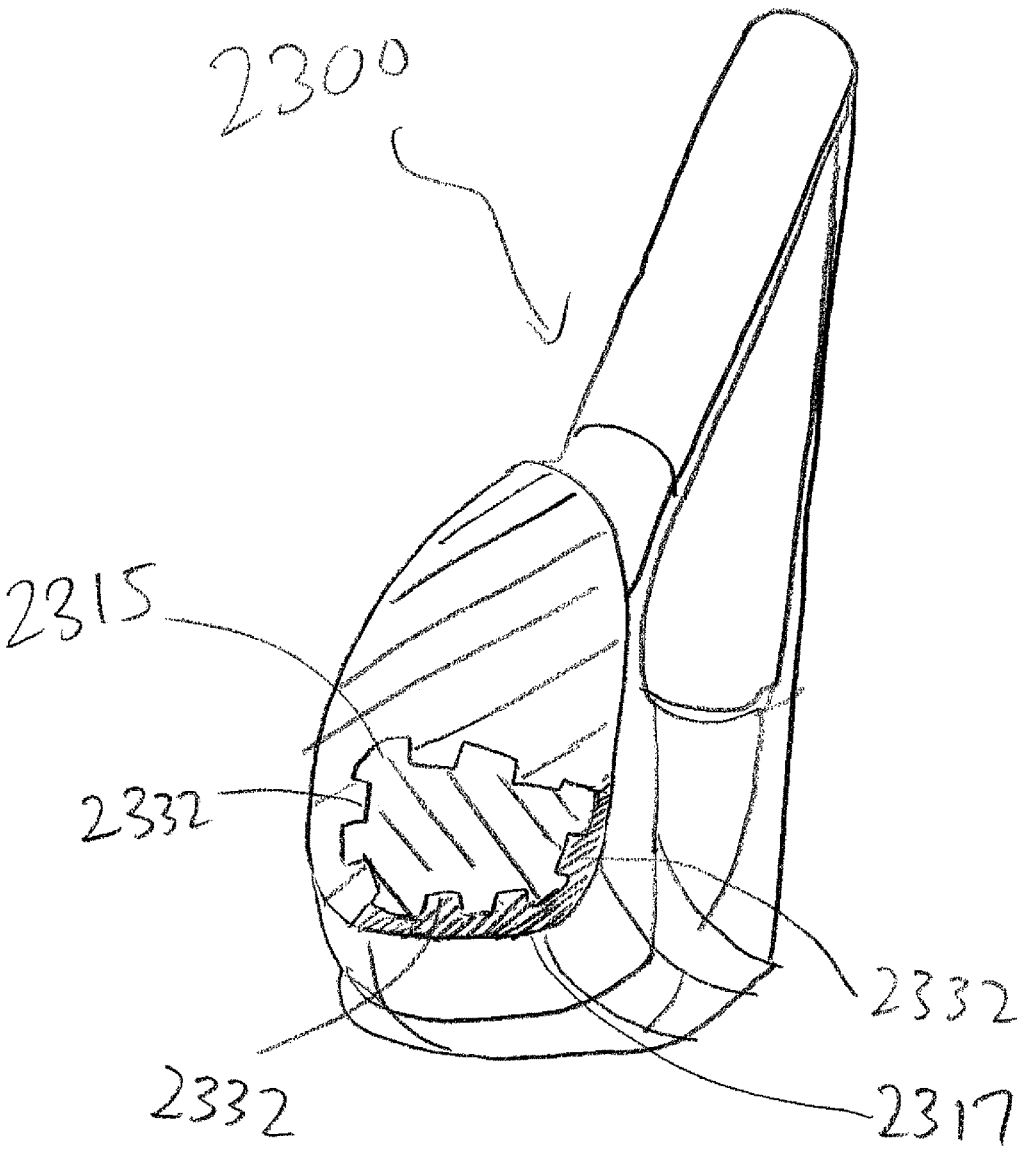
FIG. 23 shows a cross-sectional view of a golf club head in accordance with an embodiment of the present invention along cross-sectional line B-B'.

FIG. 23 provides a cross-sectional view of the golf club head 2300 along cross-sectional line B-B' as shown in FIG. 21. This current cross-sectional view of the golf club head 2300 shows that the indentations 2332 may be applied to the weight adjustment portion 2315 on the heel side weight member as well as the toe side weight member to improve the bonding between the two components without departing from the scope and content of the present invention. In fact, although not shown in the figures, the indentations could be incorporated into any weight adjustment portion at any portion of the golf club head, including the striking face portion, all without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the preceding specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A forged golf club head comprising:

a body portion made out of a first material having at least one cavity;

at least one weight adjustment portion made out of a second material encased within said body portion; and a cap, made out of said first material, at least partially enclosing said cavity;

wherein an outer surface area of said at least one weight adjustment portion equals an inner surface area of said at least one cavity wherein said first material has a first thermal expansion coefficient and said second material has a second thermal expansion coefficient, and wherein said first thermal expansion coefficient is greater than or equal to said second thermal expansion coefficient, wherein said at least one weight adjustment portion is located near a sole of said golf club head, and wherein said first thermal expansion coefficient is about 8.0 μin/in ° F., and said second thermal expansion coefficient is about 6.1 μin/in ° F.

2. The forged golf club head of claim 1, wherein said at least one weight adjustment portion is located near a heel portion of said sole of said golf club head.

3. The forged golf club head of claim 1, wherein said at least one weight adjustment portion is located near a toe portion of said sole of said golf club head.

4. The forged golf club head of claim 1, wherein said at least one weight adjustment portion further comprises one or more indentations.

5. The forged golf club head of claim 1, wherein said weight adjustment portion is made out of tungsten.

6. A forged golf club head comprising:

a body portion made out of a first material having at least one cavity;

at least one weight adjustment portion made out of a second material encased within said body portion; and a cap, made out of said first material, completely enclosing said cavity;

wherein an outer surface area of said at least one weight adjustment portion equals an inner surface area of said at least one cavity, wherein said first material has a first forging temperature and said second material has a second forging temperature, wherein said first forging temperature and said second forging temperature are substantially similar to one another, and wherein said first forging temperature is about 1,200 ° C., and said second forging temperature is about 1,100 ° C.

7. The forged golf club head of claim 6, wherein said first material has a first flow stress and said second material has a second flow stress;

Wherein said first flow stress and said second flow stress are different from one another.

8. The forged golf club head of claim 7, wherein said first flow stress is about 10 ksi and said second flow stress is about 12 ksi.

9. The forged golf club head of claim 6, wherein said first material has a first thermal expansion coefficient and said second material has a second thermal expansion coefficient, and wherein said first thermal expansion coefficient is greater than or equal to said second thermal expansion coefficient.

10. The forged golf club head of claim 9, wherein said first thermal expansion coefficient is about 8.0 μin/in ° F., and said second thermal expansion coefficient is about 6.1 μin/in ° F.

* * * * *